US012385383B2

(12) United States Patent
Hinke et al.

(10) Patent No.: US 12,385,383 B2
(45) Date of Patent: Aug. 12, 2025

(54) AUTOMATED WELLBORE RANGING

(71) Applicant: Halliburton Energy Services, Inc., Houston, TX (US)

(72) Inventors: Sean Hinke, Calgary (CA); Richard T. Hay, Spring, TX (US); Pete L. Schiermeier, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/402,997

(22) Filed: Jan. 3, 2024

(65) Prior Publication Data

US 2025/0215776 A1 Jul. 3, 2025

(51) Int. Cl.

| | |
|---|---|
| ***E21B 44/00*** | (2006.01) |
| ***E21B 7/06*** | (2006.01) |
| ***E21B 47/024*** | (2006.01) |
| ***E21B 47/09*** | (2012.01) |

(52) U.S. Cl.

CPC ..... *E21B 44/00* (2013.01); *E21B 7/06* (2013.01); *E21B 47/024* (2013.01); *E21B 47/09* (2013.01)

(58) Field of Classification Search

CPC ..... E21B 7/06; E21B 47/09; E21B 47/024; E21B 44/00

See application file for complete search history.

(56) References Cited

U.S. PATENT DOCUMENTS

| | | | | |
|---|---|---|---|---|
| 5,589,775 | A | 12/1996 | Kuckes | |
| 5,923,170 | A | 7/1999 | Kuckes | |
| 7,321,293 | B2 | 1/2008 | Kennedy et al. | |
| 2008/0041626 | A1* | 2/2008 | Clark | G01V 3/26 340/854.6 |
| 2010/0139981 | A1* | 6/2010 | Meister | E21B 47/08 175/73 |
| 2020/0040720 | A1 | 2/2020 | Zalluhoglu et al. | |
| 2020/0072034 | A1 | 3/2020 | Zalluhoglu et al. | |
| 2020/0095849 | A1 | 3/2020 | Demirer et al. | |
| 2020/0095860 | A1 | 3/2020 | Zalluhoglu et al. | |
| 2020/0355061 | A1 | 11/2020 | Gharib et al. | |
| 2020/0408084 | A1 | 12/2020 | Gu et al. | |
| 2021/0173114 | A1 | 6/2021 | Wilson et al. | |
| 2022/0003106 | A1 | 1/2022 | Benson et al. | |
| 2023/0079876 | A1 | 3/2023 | Hinke et al. | |

FOREIGN PATENT DOCUMENTS

| | | |
|---|---|---|
| WO | 2016022190 | 2/2016 |

OTHER PUBLICATIONS

International Search Report & Written Opinion; PCT Application No. PCT/US2024/010289; mailed Sep. 30, 2024.

* cited by examiner

*Primary Examiner* — Tara Schimpf
*Assistant Examiner* — Lamia Quaim
(74) *Attorney, Agent, or Firm* — NOVAK DRUCE CARROLL LLP

(57) ABSTRACT

Systems and methods for drilling a first borehole along a planned first path using a first bottom hole assembly (BHA) while drilling a second borehole using a second BHA along a second path having a defined spatial relationship to the first path. The method includes steps of measuring a distance and a direction of the first BHA relative to the second BHA, automatically adjusting the second path based in part on the measured distance and the measured direction so as to maintain the spatial relationship, and automatically steering the second BHA to follow the adjusted second path.

20 Claims, 10 Drawing Sheets

AUTOMATED WELLBORE RANGING

TECHNICAL FIELD

The present technology pertains to drilling multiple parallel wellbores.

BACKGROUND

It is sometimes desirable to drill multiple parallel wellbores into a formation. A lead wellbore is drilled with a bottom hole assembly (BHA) that includes a beacon. A follower wellbore has a BHA that includes a range-measuring receiver that detects the position of the beacon of the lead BHA. Current wellbore ranging operations rely on human intervention to acquire, process, and interpret the ranging data from the follower BHA and steer the follower drill head.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
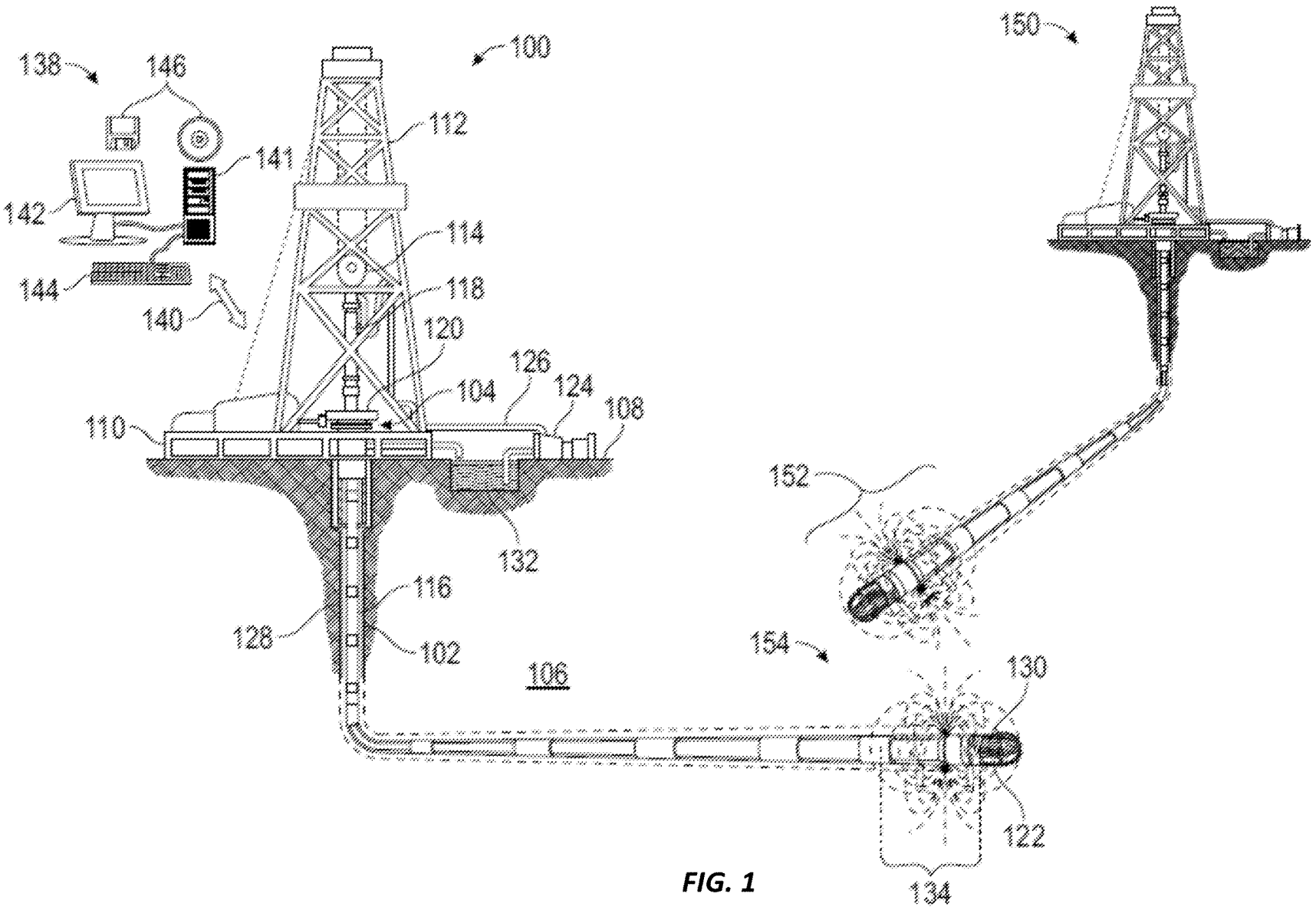
FIG. 1 illustrates an example of two drilling operations that are performing operations in the same area, in accordance with various aspects of the subject technology.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

One problem with the conventional approach to drilling multiple parallel wells at the same time is that each BHA is manually steered by a different surface operator, requiring multiple skilled operators. As the operators are often located at the separate wellheads, communication between the operators is less than ideal and coordination between the operators is difficult. This results in excessive variation in the separation and relative position of the multiple wellbores.

The disclosed technology addresses the foregoing by providing automatic control of the follower BHAs, allowing all the boreholes to be drilled using a single operator. In certain embodiments, the single operator steers only a leader BHA, which is drilling a first borehole, and other follower BHAs, which are drilling separate boreholes, operate automatically. In certain embodiments, both the leader and follower BHAs operate automatically without active steering by an operator. The leader BHA can be programmed to follow a planned path or profile. The follower BHAs can be programmed to follow the leader BHA at a predetermined offset in distance and direction or to intersect the leader borehole at designated position or steer towards or away from the leader borehole to establish a new desired offset and direction or orientation to the leader borehole. The operator can monitor the actual performance of all the BHAs and adjust one or more of the planned path and the offsets.

This produces less variation from the planned paths in the placement of the actual boreholes and reduces the number of operators required to drill the multiple boreholes. While methods and systems described below may be applied to any form of drilling operation for hydrocarbon extraction, geothermal operation, water extraction, mining, other natural resources, injection wells, and/or any form of fluid extraction or injection from or into a subterranean formation or wellbore. Systems and methods may eliminate the need to deploy a wireline source and incorporates BHA mounted source and BHA mounted receiver in a target well and offset "drilling" well with the target well being an actively drilled well or a cased or open-hole well.

As used in this document, the term "path" means centerline of a borehole defined in a three-dimensional (3D) space. A path, interchangeably referred to herein as a "profile," through the formation may consist of any attitude consisting of an inclination and/or direction or a curved or straight section, or following a geological structure(s), or any combination thereof including pluralities of these elements. A planned path will be the desired path for the borehole to be drilled through the formation. An adjusted path is the planned path modified by a follower BHA to meet the constraints of the follower BHA with respect to the leader BHA, i.e., the desired spatial relationship between the follower BHA and the leader BHA defined by the operator. A projected path is a real-time planned path originating from the current position of the respective BHA that also meets the desired spatial relationship.

As used in this document, the term "ranging transmitter" means a module configured to provide a "ranging signal," which is a time-varying energy emission, e.g., a magnetic field or an electric field or an electromagnetic field or a vibration or acoustic signal, as a beacon to be detected and/or received by other BHAs. In certain embodiments, a ranging transmitter includes a ranging device, e.g., a solenoid, or a permanent magnet as described herein. In certain embodiments, the ranging receiver modulates the magnetic field, e.g., reverses the polarity of the field one or more times such that it is time varying at intervals or continuously, to enable identification of the BHA emitting the field or to communicate with another BHA. In certain embodiments, the field of the ranging transmitter of the leader BHA can be modulated to provide a data stream to inform the follower BHA about intended curvature and/or orientation of the path of the leader BHA to aid the follower BHA to better maintain separation by anticipating curvature changes of the leader BHA. This helps maintain the desired distance, direction, orientation, and curvature limits of the follower BHA trajectory and reduce the number and degree of course corrections. In certain embodiments, this information is communicated uphole by the leader BHA, e.g., via long haul telemetry, and then downlinked to the follower BHA.

As used in this document, the term "ranging receiver" means a module configured to detect and/or receive a ranging signal of a ranging transmitter. In certain embodiments, a ranging receiver includes one or more of a magnetometer or gradiometer or appropriate sensor for receiving the energy emitted by the transmitter, e.g., a vector component magnetometer or gradiometer, a signal converter, a signal filter, a signal demodulator, and telemetry module. In certain embodiments, the ranging receiver includes at least two sensors arranged on the (x-y) cross axis plane of the longitudinal axis of the bottom hole assembly.

In some forms of ranging techniques an embodiment would entail an electric current transmitter injecting electric current into the surrounding formation. Some of that current would migrate and focus on a nearby conductive structure in the formation such as casing or another drill string in a nearby wellbore. This concentration of current flowing on the nearby structure gives off a magnetic field proportional to the amount of electric current flowing on it from the adjacent transmitter in the source BHA. This magnetic field response is subsequently measured by a receiver in the same BHA as the transmitter. These magnetic field measurements are then used to calculate the distance and direction to the nearby structure relative to the reference BHA. Both a leader and follower BHA can make such measurements of each other since both BHA's would have a transmitter and a receiver. To avoid conflicts in measurements, each BHA could detect if another BHA is transmitting first. When the transmission is detected as have ended, the BHA waiting can then make a transmission to measure its distance to the adjacent well. Hence in effect there is a time sharing for when a BHA can transmit verses not transmitting a ranging signal to avoid interfering with the adjacent receiver in the adjacent BHA.

In another embodiment, adjacent BHAs can use different transmitters and or receivers concurrently such that they don't interfere with each BHA's receiver or the receiver system is able to distinguish between two different signals such as one signal type from the BHA it is in verses a received signal from an adjacent BHA. For example, one BHA may use a rotating magnet source which the transmit frequency is a function of the speed of the rotation rate of the magnet while the other BHA may have a bistable magnetic field emission from a solenoid operating at a different frequency than that signal from the rotating magnet transmitter. Further, each BHA can have multiple forms of transmitters and receivers to transmit or detect different ranging signals. It may be beneficial for a BHA to selectively use one transmitter or receiver type over another one depending on the need for precision or detection of the adjacent drill string. For example, if both BHA's are far apart it may be necessary to use a stronger transmitter signal and more sensitive receiver settings as opposed to two BHAs that are operating closer together where a strong transmit signal may saturate the receiver sensor.

Likewise, the transmit energy strength can be adjusted autonomously via an automatic gain control in the transmitter and receiver to adjust the transmit signal and receiver sensitivity in order to optimize the detection of distance and direction to an adjacent well. Such adjustments can be made to as required to optimally detect the distance and direction to a plurality of adjacent BHAs such would be the case if two or more adjacent structures were in the vicinity of the reference BHA.

As used in this document, the term "heading" means the desired direction of the projected path of the BHA as defined in 3D space.

FIG. 1 illustrates a drilling operation 100 in accordance with example embodiments. As illustrated, borehole 102 may extend from a wellhead 104 into a subterranean formation 106 from a surface 108. Generally, borehole 102 may include horizontal, vertical, slanted, curved, and other types of borehole geometries and orientations. Borehole 102 may be cased or uncased. In examples, borehole 102 may include a metallic member. By way of example, the metallic member may be a casing, liner, tubing, or other elongated steel tubular disposed in borehole 102.

As illustrated, borehole 102 may extend through subterranean formation 106. As illustrated in FIG. 1, borehole 102 may extend generally vertically into the subterranean formation 106, however borehole 102 may extend at an angle through subterranean formation 106, such as horizontal and slanted boreholes. For example, although FIG. 1 illustrates a vertical or low inclination angle well, high inclination angle or horizontal placement of the well and equipment may be possible. It should further be noted that while FIG. 1 generally depict land-based operations, those skilled in the art may recognize that the principles described herein are equally applicable to subsea operations that employ floating or sea-based platforms and rigs, without departing from the scope of the disclosure.

As illustrated, a drilling platform 110 may support a derrick 112 having a traveling block 114 for raising and lowering drill string 116. Drill string 116 may include, but is not limited to, drill pipe and coiled tubing, as generally known to those skilled in the art. A kelly 118 may support drill string 116 as it may be lowered through a rotary table 120. A drill bit 122 may be attached to the distal end of drill string 116 and may be driven either by a downhole motor and/or via rotation of drill string 116 from surface 108. Without limitation, drill bit 122 may include roller cone bits, PDC bits, natural diamond bits, any hole openers, reamers, coring bits, and the like. As drill bit 122 rotates, it may create and extend borehole 102 that penetrates various subterranean formations 106. A pump 124 may circulate drilling fluid through a feed pipe 126 through kelly 118, downhole through interior of drill string 116, through orifices in drill bit 122, back to surface 108 via annulus 128 surrounding drill string 116, and into a retention pit 132.

With continued reference to FIG. 1, drill string 116 may begin at wellhead 104 and may traverse borehole 102. Drill bit 122 may be attached to a distal end of drill string 116 and may be driven, for example, either by a downhole motor and/or via rotation of drill string 116 from surface 108. Drill bit 122 may be a part of a rotary steerable system (RSS) 130 at distal end of drill string 116. In other examples, drill bit 122 may be a part of a mud motor, discussed below. RSS 130 may further include tools for real-time health assessment of a rotary steerable tool during drilling operations. As will be appreciated by those of ordinary skill in the art, RSS 130 may be a measurement-while drilling (MWD) or logging-while-drilling (LWD) system.

RSS 130 may comprise any number of tools, such as sensors, transmitters, and/or receivers to perform downhole measurement operations or to perform real-time health assessment of a rotary steerable tool during drilling operations. For example, as illustrated in FIG. 1, RSS 130 may be included on and/or with a BHA 134. It should be noted that BHA 134 may make up at least a part of RSS 130. Without limitation, any number of different measurement assemblies, communication assemblies, battery assemblies, and/or the like may form RSS 130 with BHA 134. Additionally, BHA 134 may form RSS 130 itself. In examples, BHA 134 may comprise one or more sensors 136. Sensors 136 may be connected to information handling system 138, discussed below, which may further control the operation of sensors 136. Sensors 136 may include (accelerometers, magnetometers, temperature sensors, speed, position sensors, etc.). During operations, sensors 136 may process real time data originating from various sources such as diagnostics data, sensor measurements, operational data, survey measurements, sensory state, drilling operation 100 state, BHA 134 state, RSS 130 state, and/or the like. Information and/or measurements may be processed further by information handling system 138 to determine real time heal assessment of rotary steerable tool.

Without limitation, RSS 130 may be connected to and/or controlled by information handling system 138, which may be disposed on surface 108. Without limitation, information handling system 138 may be disposed downhole in RSS 130. Processing of information recorded may occur downhole and/or on surface 108. Processing occurring downhole may be transmitted to surface 108 to be recorded, observed, and/or further analyzed. Additionally, information recorded on information handling system 138 that may be disposed downhole may be stored until RSS 130 may be brought to surface 108. In examples, information handling system 138 may communicate with RSS 130 through a communication line (not illustrated) disposed in (or on) drill string 116. In examples, wireless communication may be used to transmit information back and forth between information handling system 138 and RSS 130. Information handling system 138 may transmit information to RSS 130 and may receive as well as process information recorded by RSS 130. In examples, a downhole information handling system (not illustrated) may include, without limitation, a microprocessor or other suitable circuitry, for estimating, receiving and processing signals from RSS 130. Downhole information handling system (not illustrated) may further include additional components, such as memory, input/output devices, interfaces, and the like. In examples, while not illustrated, RSS 130 may include one or more additional components, such as analog-to-digital converter, filter and amplifier, among others, which may be used to process the measurements of RSS 130 before they may be transmitted to surface 108. Alternatively, raw measurements from RSS 130 may be transmitted to surface 108.

Any suitable technique may be used for transmitting signals from RSS 130 to surface 108, including, but not limited to, wired pipe telemetry, mud-pulse telemetry, acoustic telemetry, and electromagnetic telemetry. While not illustrated, RSS 130 may include a telemetry subassembly that may transmit telemetry data to surface 108. At surface 108, pressure transducers (not shown) may convert the pressure signal into electrical signals for a digitizer (not illustrated). The digitizer may supply a digital form of the telemetry signals to information handling system 138 via a communication link 140, which may be a wired or wireless link. The telemetry data may be analyzed and processed by information handling system 138.

As illustrated, communication link 140 (which may be wired or wireless, for example) may be provided that may transmit data from RSS 130 to an information handling system 138 at surface 108. Information handling system 138 may include a personal computer 141, a video display 142, a keyboard 144 (i.e., other input devices), and/or non-transitory computer-readable media 146 (e.g., optical disks, magnetic disks) that can store code representative of the methods described herein. In addition to, or in place of processing at surface 108, processing may occur downhole as information handling system 138 may be disposed on RSS 130. Likewise, information handling system 138 may process measurements taken by one or more sensors 136 automatically or send information from sensors 136 to the surface. As discussed above, the software, algorithms, and modeling are performed by information handling system 138. Information handling system 138 may perform steps, run software, perform calculations, and/or the like automatically, through automation (such as through machine learning or substantially in real-time.

Figure 2:
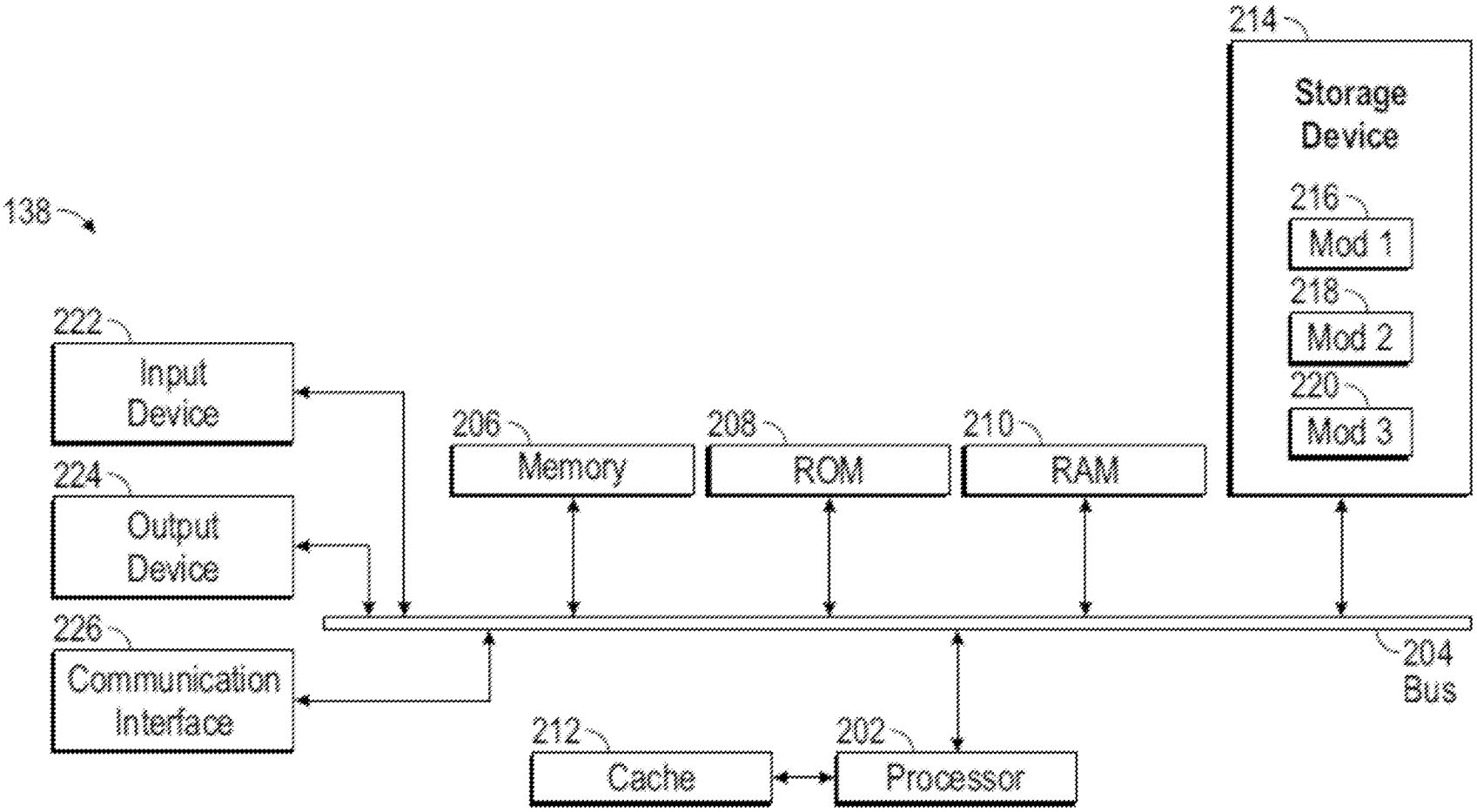
FIG. 2 illustrates an example of an information handling system, in accordance with various aspects of the subject technology.

FIG. 2 illustrates an example information handling system 138 which may be employed to perform various steps, methods, and techniques disclosed herein. Persons of ordinary skill in the art will readily appreciate that other system examples are possible. As illustrated, information handling system 138 includes a processing unit (CPU or processor) 202 and a system bus 204 that couples various system components including system memory 206 such as read only memory (ROM) 208 and random access memory (RAM) 210 to processor 202. Processors disclosed herein may all be forms of this processor 202. Information handling system 138 may include a cache 212 of high-speed memory connected directly with, in close proximity to, or integrated as part of processor 202. Information handling system 138 copies data from memory 206 and/or storage device 214 to cache 212 for quick access by processor 202. In this way, cache 212 provides a performance boost that avoids processor 202 delays while waiting for data. These and other modules may control or be configured to control processor 202 to perform various operations or actions. Other system memory 206 may be available for use as well. Memory 206 may include multiple different types of memory with different performance characteristics. It may be appreciated that the disclosure may operate on information handling system 138 with more than one processor 202 or on a group or cluster of computing devices networked together to provide greater processing capability. Processor 202 may include any general purpose processor and a hardware module or software module, such as first module 216, second module 218, and third module 220 stored in storage device 214, configured to control processor 202 as well as a special purpose processor where software instructions are incorporated into processor 202. Processor 202 may be a self-contained computing system, containing multiple cores or processors, a bus, memory controller, cache, etc. A multi-core processor may be symmetric or asymmetric. Processor 202 may include multiple processors, such as a system having multiple, physically separate processors in different sockets, or a system having multiple processor cores on a single physical chip. Similarly, processor 202 may include multiple distributed processors located in multiple separate computing devices but working together such as via a communications network. Multiple processors or processor cores may share resources such as memory 206 or cache 212 or may operate using independent resources. Processor 202 may include one or more state machines, an application specific integrated circuit (ASIC), or a programmable gate array (PGA) including a field PGA (FPGA).

Each individual component discussed above may be coupled to system bus 204, which may connect each and every individual component to each other. System bus 204 may be any of several types of bus structures including a memory bus or memory controller, a peripheral bus, and a local bus using any of a variety of bus architectures. A basic input/output (BIOS) stored in ROM 208 or the like, may provide the basic routine that helps to transfer information between elements within information handling system 138, such as during start-up. Information handling system 138 further includes storage devices 214 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 214 may include software modules 216, 218, and 220 for controlling processor 202. Information handling system 138 may include other hardware or software modules. Storage device 214 is connected to the system bus 204 by a drive interface. The drives and the associated computer-readable storage devices provide nonvolatile storage of computer-readable instructions, data structures, program modules and other data for information handling system 138. In one aspect, a hardware module that performs a particular function includes the software component stored in a tangible computer-readable storage device in connection with the necessary hardware components, such as processor 202, system bus 204, and so forth, to carry out a particular function. In another aspect, the system may use a processor and computer-readable storage device to store instructions which, when executed by the processor, cause the processor to perform operations, a method or other specific actions. The basic components and appropriate variations may be modified depending on the type of device, such as whether information handling system 138 is a small, handheld computing device, a desktop computer, or a computer server. When processor 202 executes instructions to perform "operations", processor 202 may perform the operations directly and/or facilitate, direct, or cooperate with another device or component to perform the operations.

As illustrated, information handling system 138 employs storage device 214, which may be a hard disk or other types of computer-readable storage devices which may store data that are accessible by a computer, such as magnetic cassettes, flash memory cards, digital versatile disks (DVDs), cartridges, random access memories (RAMs) 210, read only memory (ROM) 208, a cable containing a bit stream and the like, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with information handling system 138, an input device 222 represents any number of input mechanisms, such as a microphone for speech, a touch-sensitive screen for gesture or graphical input, keyboard, mouse, motion input, speech and so forth. Additionally, input device 222 may take in data from one or more sensors 136, discussed above. An output device 224 may also be one or more of a number of output mechanisms known to those of skill in the art. In some instances, multimodal systems enable a user to provide multiple types of input to communicate with information handling system 138. Communications interface 226 generally governs and manages the user input and system output. There is no restriction on operating on any particular hardware arrangement and therefore the basic hardware depicted may easily be substituted for improved hardware or firmware arrangements as they are developed.

As illustrated, each individual component described above is depicted and disclosed as individual functional blocks. The functions these blocks represent may be provided through the use of either shared or dedicated hardware, including, but not limited to, hardware capable of executing software and hardware, such as a processor 202, that is purpose-built to operate as an equivalent to software executing on a general purpose processor. For example, the functions of one or more processors presented in FIG. 2 may be provided by a single shared processor or multiple processors. Use of the term "processor" should not be construed to refer exclusively to hardware capable of executing software. Illustrative embodiments may include microprocessor and/or digital signal processor (DSP) hardware, read-only memory (ROM) 208 for storing software performing the operations described below, and random-access memory (RAM) 210 for storing results. Very large-scale integration (VLSI) hardware embodiments, as well as custom VLSI circuitry in combination with a general-purpose DSP circuit, may also be provided.

The logical operations of the various methods, described below, are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. Information handling system 138 may practice all or part of the recited methods, may be a part of the recited systems, and/or may operate according to instructions in the recited tangible computer-readable storage devices. Such logical operations may be implemented as modules configured to control processor 202 to perform particular functions according to the programming of software modules 216, 218, and 220.

In examples, one or more parts of the example information handling system 138, up to and including the entire information handling system 138, may be virtualized. For example, a virtual processor may be a software object that executes according to a particular instruction set, even when a physical processor of the same type as the virtual processor is unavailable. A virtualization layer or a virtual "host" may enable virtualized components of one or more different computing devices or device types by translating virtualized operations to actual operations. Ultimately, however, virtualized hardware of every type is implemented or executed by some underlying physical hardware. Thus, a virtualization compute layer may operate on top of a physical compute layer. The virtualization compute layer may include one or more virtual machines, an overlay network, a hypervisor, virtual switching, and any other virtualization application.

Figure 3:
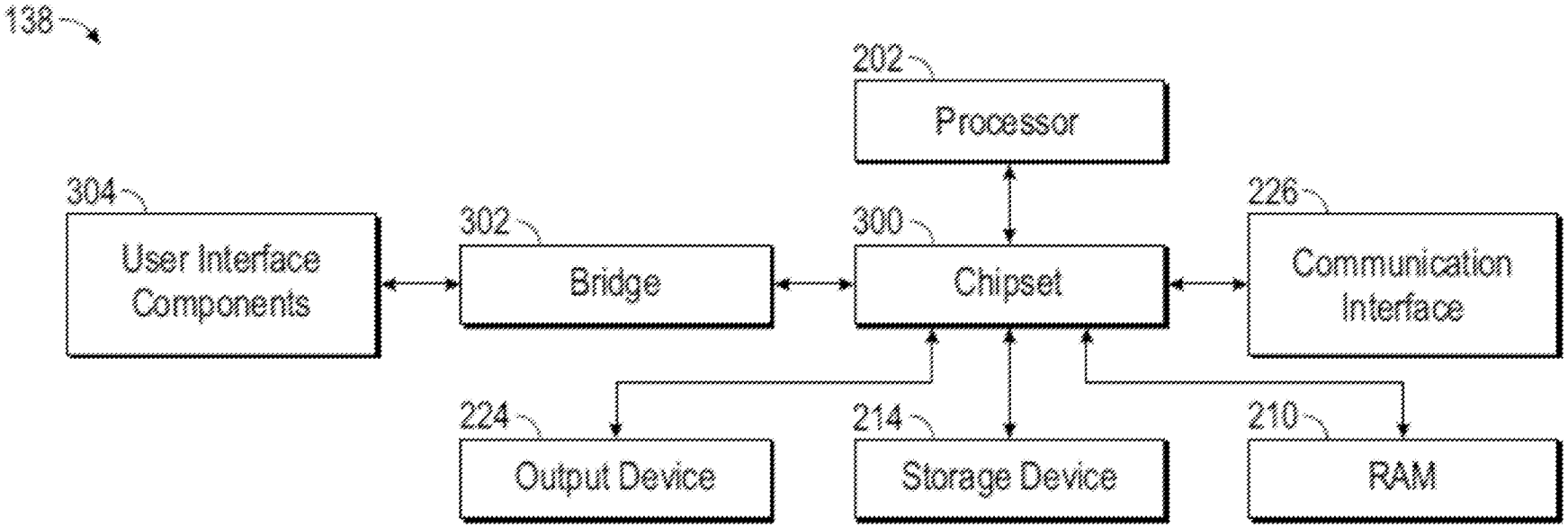
FIG. 3 illustrates an example of a chips set used in the information handling system, in accordance with various aspects of the subject technology.

FIG. 3 illustrates an example information handling system 138 having a chipset architecture that may be used in executing the described method and generating and displaying a graphical user interface (GUI). Information handling system 138 is an example of computer hardware, software, and firmware that may be used to implement the disclosed technology. Information handling system 138 may include a processor 202, representative of any number of physically and/or logically distinct resources capable of executing software, firmware, and hardware configured to perform identified computations. Processor 202 may communicate with a chipset 300 that may control input to and output from processor 202. In this example, chipset 300 outputs information to output device 224, such as a display, and may read and write information to storage device 214, which may include, for example, magnetic media, and solid-state media. Chipset 300 may also read data from and write data to RAM 210. A bridge 302 for interfacing with a variety of user interface components 304 may be provided for interfacing with chipset 300. Such user interface components 304 may include a keyboard, a microphone, touch detection and processing circuitry, a pointing device, such as a mouse, and so on. In general, inputs to information handling system 138 may come from any of a variety of sources, machine generated and/or human generated.

Chipset 300 may also interface with one or more communication interfaces 226 that may have different physical interfaces. Such communication interfaces may include interfaces for wired and wireless local area networks, for broadband wireless networks, as well as personal area networks. Some applications of the methods for generating, displaying, and using the GUI disclosed herein may include receiving ordered datasets over the physical interface or be generated by the machine itself by processor 202 analyzing data stored in storage device 214 or RAM 210. Further, information handling system 138 receive inputs from a user via user interface components 304 and execute appropriate functions, such as browsing functions by interpreting these inputs using processor 202.

In examples, information handling system 138 may also include tangible and/or nontransitory computer-readable storage devices for carrying or having computer-executable instructions or data structures stored thereon. Such tangible computer-readable storage devices may be any available device that may be accessed by a general purpose or special purpose computer, including the functional design of any special purpose processor as described above. By way of example, and not limitation, such tangible computer-readable devices may include RAM, ROM, EEPROM, CD-ROM or other optical disk storage, magnetic disk storage or other magnetic storage devices, or any other device which may be used to carry or store desired program code in the form of computer-executable instructions, data structures, or processor chip design. When information or instructions are provided via a network, or another communications connection (either hardwired, wireless, or combination thereof), to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general-purpose computer, special purpose computer, or special purpose processing device to perform a certain function or group of functions. Computer-executable instructions also include program modules that are executed by computers in standalone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

FIG. 1 further illustrates a second drilling operation 150 that may be in the vicinity of drilling operation 100. Although two drilling operations are illustrated, there may be any number of drilling operations ongoing that may interfere with each other. Likewise, there may be one or more completed wells in the vicinity of active drilling operations. Second drilling operation 150 may comprise all items identified for drilling operation 100. As illustrated a second BHA 152 may operate and function in the vicinity of BHA 134. The ability of second BHA 152 and BHA 134 to identify each other within formation 106 may prevent second BHA 152 and BHA 134 from contacting each other during drilling operations. As illustrated, an electromagnetic field 154 may be emitted from BHA 134. This field may emanate from a solenoid source discussed below. Electromagnetic field 154 may be sensed by one or more receivers, discussed below, that are disposed on BHA 152.

Figure 4A:
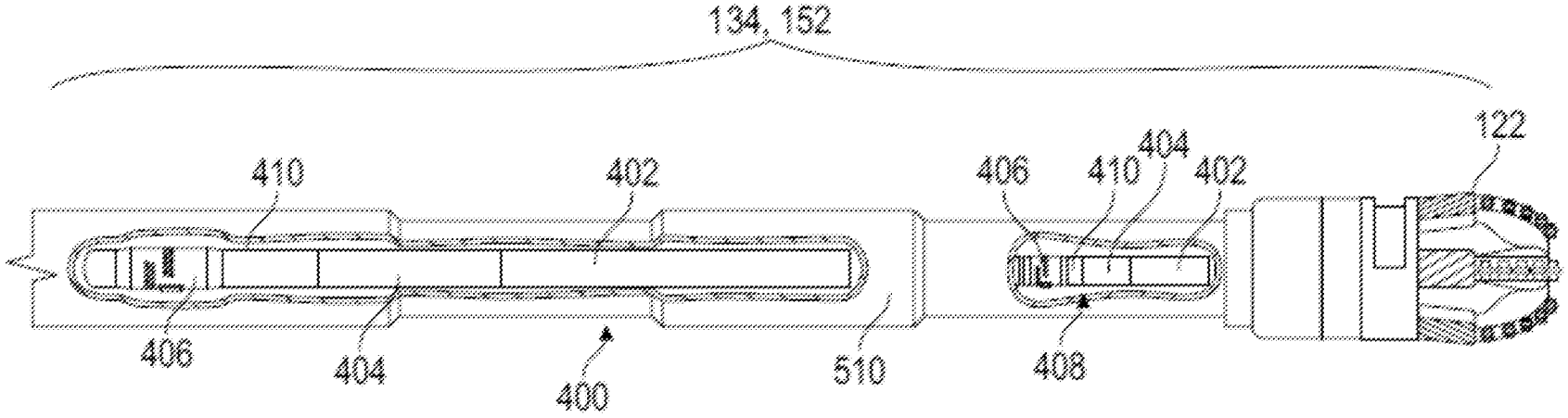
FIG. 4A illustrates an example of a ranging device disposed on a BHA, in accordance with various aspects of the subject technology.

FIG. 4A illustrates a cutaway for BHA 134 and/or second BHA 152. BHA 134 may comprise a ranging device 400 disposed in or about BHA 134 and/or BHA 152. Ranging device 400 may comprise of solenoid 402, which may be powered by one or more batteries 404, a turbine 406, and/or capacitors 410. In examples, BHA 134 and/or second BHA 152 may further comprise a secondary ranging device 408, which also comprises a solenoid 402, one or more batteries 404, a turbine 406, and/or capacitors 410. During operations, secondary ranging device 408 may be utilized if ranging device 400 fails or may be utilized with ranging device 400. Both ranging device 400 and secondary ranging device 408 may be utilized to identify and range between a plurality of BHAs and completed wells. To perform ranging operations between BHAs, one or more receivers may be used on each BHA.

Figure 4B:
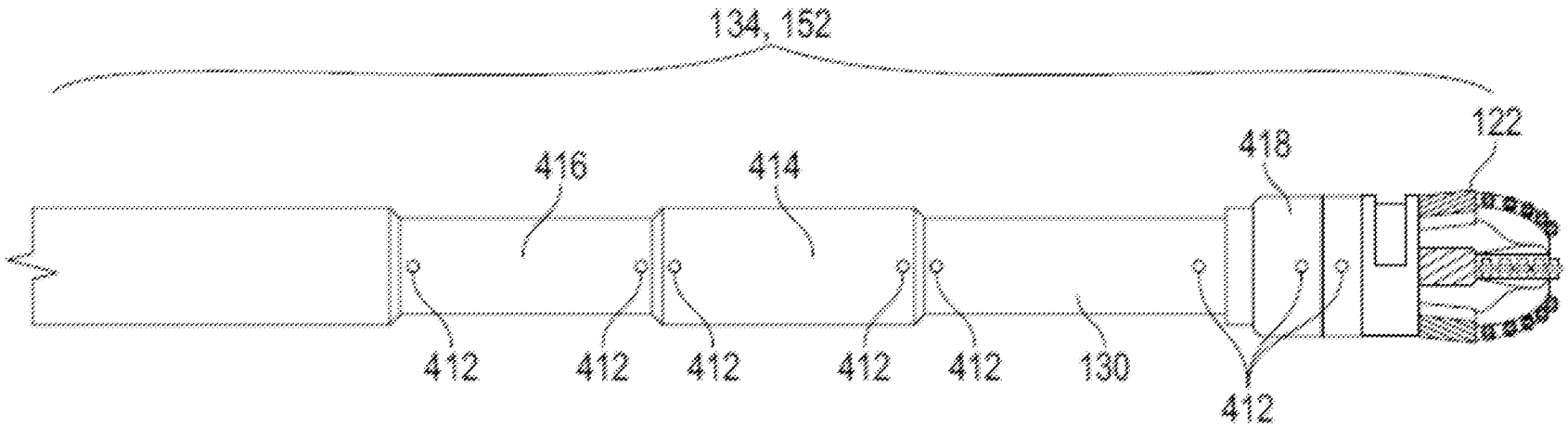
FIG. 4B illustrates one or more receivers disposed on the BHA, in accordance with various aspects of the subject technology.

FIG. 4B illustrates one or more receivers 412 disposed at different locations within and/or along BHA 134 and/or second BHA 152. In examples, receiver 412 may be a single, a dual, and/or a triaxial magnetometers. In examples, receiver 412 may automatically increase in scale or decrease in scale based on a scaling resolution sought for measurements. Generally, the scaling resolution may increase as the source strength increases as proximity decreases between receiver 412 and ranging device 400. Scaling resolution may decrease as the source strength decreases and as proximity increases between receiver 412 and ranging device 400. Receivers 412 may be disposed on an RSS 130, drill bit 122, MWD/LWD subs 414, mud motor 416, and/or collars 418 that connect one or more subs and/or devices of BHA 134 and/or second BHA 152. Receivers may operate and function to receive either an AC or DC based signal emanating from ranging device 400. During ranging operations, receivers 412 may measure the electromagnetic, magnetic field emanating from solenoid 402 by measuring the amplitude between the peaks of the polarity switch of solenoid 402. These measurements may be sent to information handling system 138, which may then compare the measurements collected downhole to a previously collected downhole measurements (i.e., stored in a database) and known decay rate in the magnetic field emitted from solenoid 402. From this dataset, a calculation of the relative distance from solenoid 402 and from the three components of the field the direction to the center of the magnetic source, to receiver 412 may be determined.

Figure 5A:
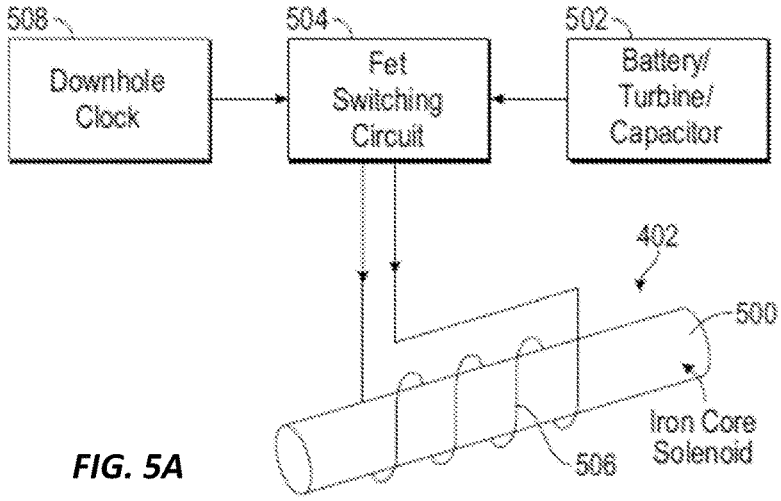
FIGS. 5A-5C illustrate different examples of one or more windings disposed around a solenoid, in accordance with various aspects of the subject technology.

FIG. 5A illustrates solenoid 402, which may be disposed in BHA 134 (e.g., referring to FIG. 1), used in ranging device 400. Solenoid 402 may comprise a laminated core 500 that may be of variable length with a length not less than one meter. To provide the desired magnetic field, this solenoid may utilize a sufficient power output to magnetically saturate the iron core, for example, and this is supplied by downhole power supply 502 connected to a polarity reversing FET (field effect transistor) switching circuit 504 connected across solenoid winding 506. Additionally, FET switching circuit 504 may be further controlled by downhole clock 508, which may further help in the creating of a desired magnetic field. Downhole power supply 502 may be a battery, a turbine, a capacitor, and/or the like and any combination thereof. In examples, the number of solenoid windings 506 around core 500 increase an electromagnetic field 154 emitted (e.g., referring to FIG. 1) from ranging device 400. Solenoid 402 may contain multiple layers of solenoid winding 506 such that the magnetic field may be varied from each independent ranging device 400. This may be accomplished by adding layers of solenoid winding 506 and therefore turns per unit length and/or overall length of solenoid 402 that is being utilized at any given point in time. Additionally, information handling system 138 may select one or multiple layers to be energized at any given time utilizing one or more FET switching circuits 504.

Figure 5B:
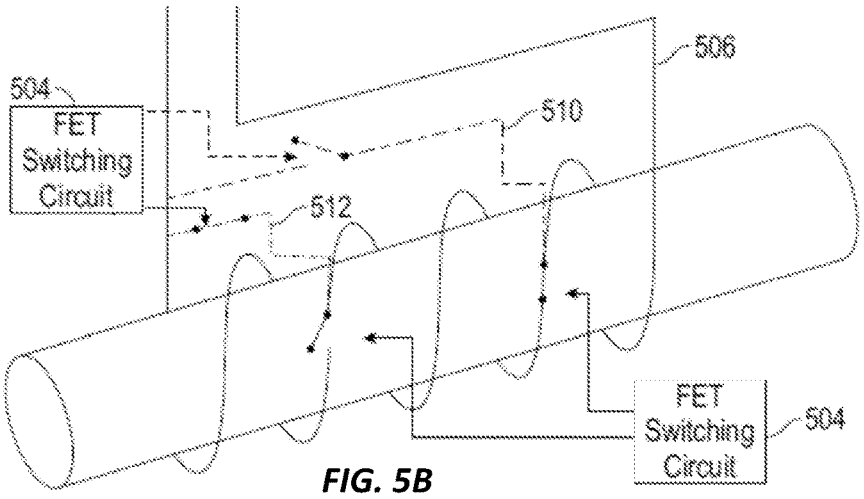

FIG. 5B illustrates an example of how one or more switching circuits 504 such as FETs, relays or solid-state switches may control current flow through solenoid windings 506, a second solenoid winding 510, and/or a third solenoid winding 512. Each additional winding may represent a new layer that may be above and/or below another layer.

Figure 5C:
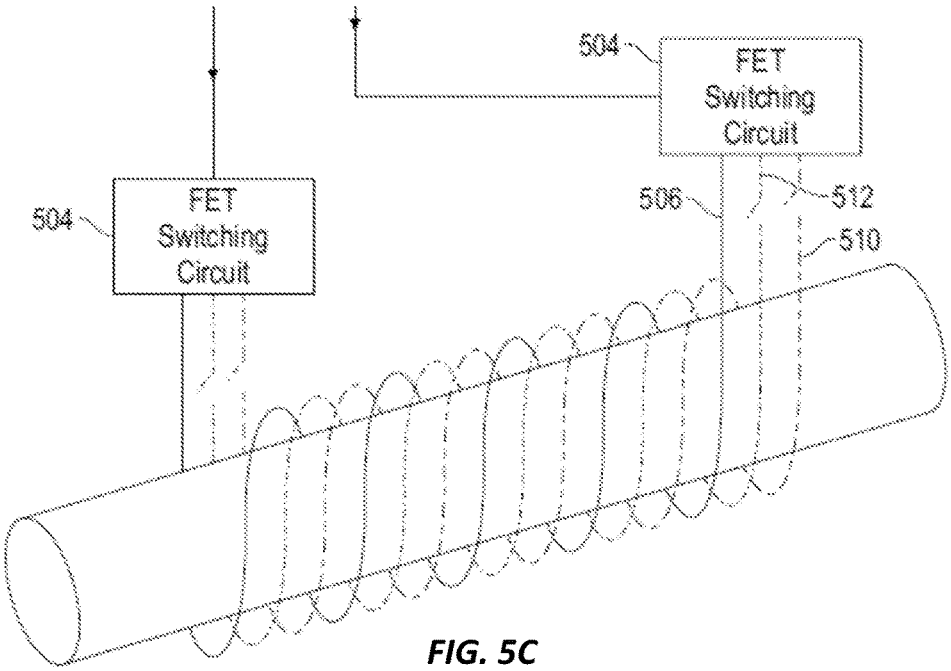

FIG. 5C illustrates another example of solenoid windings 506, a second solenoid winding 510, and/or a third solenoid winding 512 in which switching circuits 504 control current through each layer. Likewise, the direction of electric current flow applied through each solenoid winding 506 layer may be controlled by information handling system 138. For example, a user may adjust the amperage through each solenoid winding 506 layer and/or the number of layers energized to control the magnitude of the electromagnetic field formed by ranging device 400.

During operations, receiver 412, discussed above and below, may be controlled by information handling system 138 to sense electromagnetic field 154 generated by ranging device 400. Generally, first BHA 134 may transmit electromagnetic field 154, which may be sensed and/or measured by one or more receivers 412 on BHA 152, or vice verso. As energy is scarce in a downhole environment, the field strength sensed or gradient of field strength across receiver 412 measured may be controlled by a user at surface using information handling system 138. For example, if ranging device 400 is generating an electromagnetic field 154 and it is not sensed by one or more receivers 412 on the opposed BHA, then the user may increase electromagnetic field 154. This may be done, as discussed above by increasing the amperage moving through a solenoid winding 506 layer or increasing the number of solenoid winding 506 layers that may be utilized. Therefore, electromagnetic field 154 may increase in size and strength until sensed by at least one receiver 412 on the opposite BHA. As both BHAs move closer together, amperage and the number of solenoid winding 506 layers may be reduced. This prevents receivers 412 from being saturated by electromagnetic field 154 and may allow for a user to determine distance and direction between the BHAs. Saturation of receivers 412 may be reviewed by a user utilizing information handling system 138.

Figure 6:
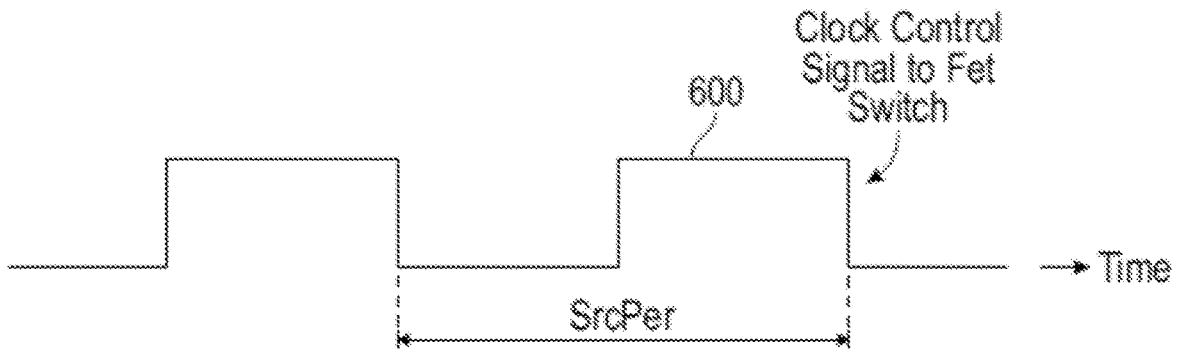
FIG. 6 is a graph of the transmission of the ranging device, in accordance with various aspects of the subject technology.

FIG. 6 illustrates that electric current flow may be periodically reversed by a reference square wave with a precise cycle period of between 0.001 and 100,000 cycles per second derived from clock signals 600, were some ideal cycle periods could be from 0.1 to 100 cycles per second, generated by a timing circuit such as crystal oscillator having a frequency that is precise to a few parts per million.

Figure 7:
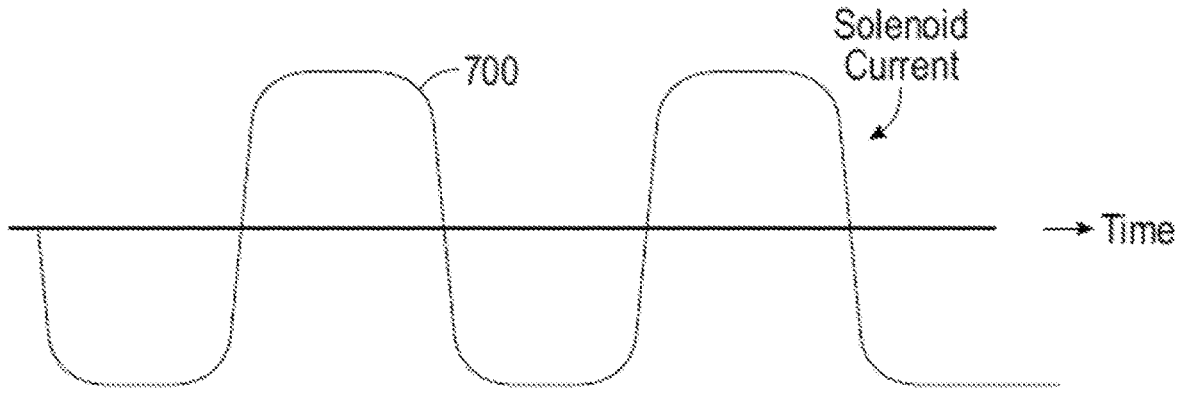
FIG. 7 is a graph of solenoid current vs. time waveform, in accordance with various aspects of the subject technology.

FIG. 7 illustrates a solenoid current waveform 700 that produces a magnetic dipole field of alternating polarity. Although the principles of physics-governing the behavior of the magnetic fields used in the analysis to be described are those appropriate to time independent magnetic fields, it is desirable to repeatedly reverse the direction of current flow in the solenoid to allow precise separation of the solenoid field from the Earth's magnetic field and from instrumental and magnetic field noise. It is also possible to simply turn the solenoid current on and off and to record the field differences. In this case the amplitude of the alternating polarity component of the magnetic dipole and field produced will be one half that produced if the current is reversed.

Figure 8:
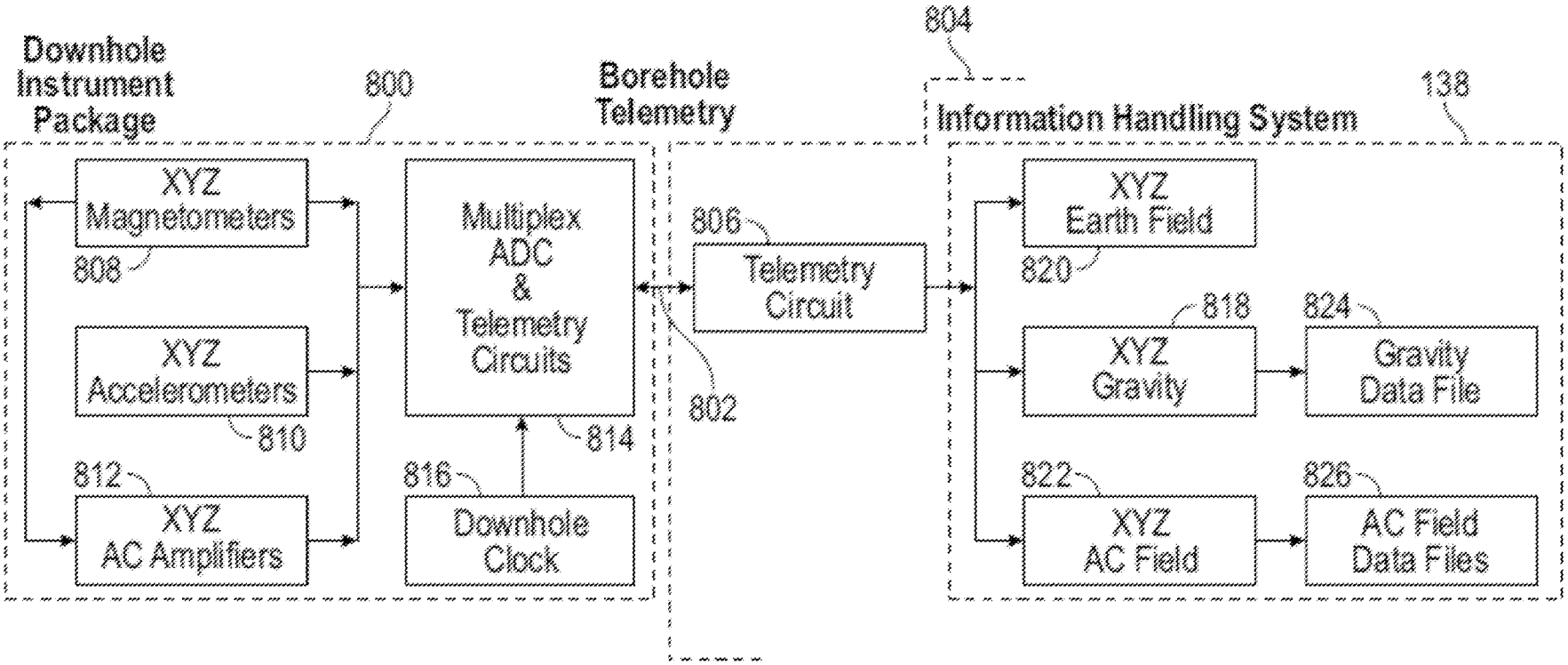
FIG. 8 illustrates configuration of one or more components to power and operate the ranging device, in accordance with various aspects of the subject technology, in accordance with various aspects of the subject technology.

FIG. 8 depicts a schematic diagram of an example downhole measuring apparatus 800 is as being connected via a borehole telemetry link 802 to an uphole drilling control room 804 within drilling operations 100 on Earth's surface 108 (e.g., referring to FIG. 1). Control room 804 has information handling system 138 for processing the data received from the downhole electronics and a controller for operating drilling operations. Downhole instrument package 800 may comprise a three-vector component magnetometer 808 and a three-vector component accelerometer 810, each of which generates output signals with respect to an xyz set of axes. The z axis of downhole instrument package 800 is aligned with borehole 102 being drilled, and the perpendicular x and y axes have a known orientation alignment to the drill face; i.e., to the direction of a bent housing in the drilling motor which controls the direction of drilling. The magnetometer AC outputs are passed through band-pass amplifiers 812 and are multiplexed with the magnetometer DC outputs and the accelerometer outputs at multiplexer 814, where the signals are converted from analog to digital form and finally put into a form suitable for telemetry to the surface. The timing for digitization and telemetry is generated by a downhole clock 816 controlled by a quartz crystal whose frequency is precise to a few parts per million.

In one embodiment, during drilling operations, drilling may be halted from time to time at a measurement station along the proposed borehole path, to perform a ranging measurement utilizing ranging device 400. The resulting reversing field with an alternating polarity component is detected by magnetometers contained with 412 and/or 800, the resulting output signals are transmitted uphole, a few minutes of data are recorded, and a data file is generated. During each set of measurement operations, the downhole multiplexer circuitry 814 sequentially samples the output voltages of magnetometers 808 and accelerometers 810 at fixed time intervals and telemeters the results to information handling system 138 at surface 108, which separates the gravity measurements at 818 from the Earth's field measurements at 820 and the AC field measurements at 822. Results are sent through a telemetry circuit 806, that may connect information handling system 138 to downhole instrument package 800. The relative time at which each measurement is made is precisely preserved by the position it has in the serial data stream being telemetered, and the gravity data and AC field data are stored at data files 824 and 826, respectively. Information handling system 138 generates from the gravity data a single row, three column matrix gxyz with elements gx, gy and gz, which are the representation of the measured gravity g in the xyz coordinate system. From the magnetometer measurement data, two 3-column matrices h1 and h2 are generated. The first matrix h1 has three columns h1x, h1y, and h1z which are tabulations of the time sequence of the digitized magnetometer measurement data from the first orientation of the solenoid. The second matrix h2 has three columns h2x, h2y, and h2z which are tabulations of the time sequence of magnetic field measurements from the second orientation of the solenoid.

In other embodiments, magnetometers 808 or gradiometers (magnetometer arrays measuring the gradient of a magnetic field) may be used to detect signal from ranging device 400 as receiver 412. Magnetometers 412/808 may be placed anywhere along BHA 134. For example, magnetometers 808 may be disposed within, on, or about, drill bits, bit subs, RSS 130, in drill bit 122, drill pipe, coil tubing, drill collars or subs, and/or integrated into MWD/LWD tools.

Magnetometers 808 may have a minimum single axis capability and may be disposed along drill string 116. Magnetometers 808 may be utilized for ranging measurements. Ranging measurements may not be tied to survey measurements but may be used to correct survey measurements and to correct borehole azimuth relative to reference borehole ranging data.

Before drilling operations and after ranging signal transmissions, solenoid 402 may be degaussed before installation to remove or reduce remnant magnetic field along core affecting other magnetometer readings. Solenoid 402 may be positioned at any suitable location along or within one or more BHAs 134, within an RSS, within a drill bit, downhole drive, such as positive displacement or turbine motor, pulse power boring system, microwave boring system, laser boring system, steel or other shot impingement boring system, or any other form or rock excavation system, MWD/LWD components, drill collars, drill pipe, coil tubing all of which could be comprising of a material of non-magnetic types such as austenitic stainless steel alloys, titanium, aluminum, composite materials such as carbon fiber based composites, and/or above or below any of the locations listed. Multiple transmitters, which may have similar or varying size or transmit signal strength may be positioned within the BHA 134. This may allow personnel to optionally select which transmitter is utilized at any time during drilling operations. As noted above, one or more BHAs 134 may be used as both, or individually, a ranging device 400 and receiver 412. For example, one or more BHAs 134 may have a ranging transmitter 402 installed on any of the BHAs 134 for transmission. This is especially beneficial for aiding adjacent BHA's that are in seek or follow mode that may be further behind the leading BHA and by moving a transmitter signal launch point further back into the BHA where signal detection may be better by the following BHA receiver.

Similarly, there may be a plurality of ranging signal receivers distributed along the BHA. This can be used by the leading BHA to detect seeking transmissions from a following BHA from other receive points along the leading BHA. The leading BHA may then select an appropriate ranging transmitter to aid the seeking or following BHA to maintain recognition of its spacing relative to the leading BHA or the leading BHA's drill string. In some embodiments, a transmitter can have unique identifying characteristics to its transmit signal such that a receiving BHA can identify what ranging signal transmitter in which BHA or drill string it has received from onto in the leading BHA to aid in relational positional identification relative to the following BHA. The unique identification of the ranging transmitter signal could include specific or variations in signal frequencies, variations in signal modulation or timing, or an embedded digital signal in the ranging transmitter signal, or a separate identification signal separate from the intended ranging transmit signal such as a preamble identification signal or a post ranging signal transmission identification signal.

Downhole operations may also include a pair or acoustic/sonic measurement tools with one tool acting as the transmitter and a second tool acting as a receiver. This may also be accomplished through utilizing a pair of long-range induction-based resistivity measurement tools which may co-locate each other through transmission and receiving of frequency and phase firing from the resistivity tool or other methods of ranging signal transmission and reception using electromagnetic induction based antenna systems on the BHA.

Figure 9:
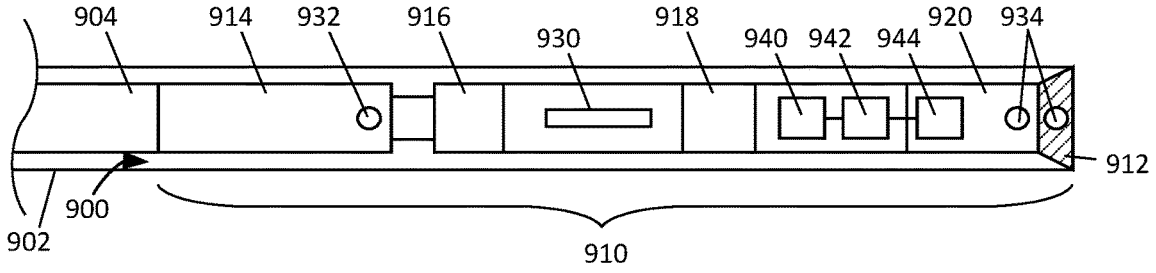
FIG. 9 depicts an example BHA, in accordance with various aspects of the subject technology.

FIG. 9 depicts an example BHA 910, in accordance with various aspects of the subject technology. The BHA 910 is coupled to a downhole drive 914, e.g., a mud motor, that is further coupled to a drill string 904. The BHA 910 comprises a drill bit 912 and, in this example, is drilling a borehole 900 having a borehole wall 902. The BHA 910 comprises a long-haul telemetry module 916, an MWD/LWD module 918, an RSS 920, a ranging transmitter 930, a ranging receiver 940, a lead-follow controller 942, and a steering controller 944.

In certain embodiments, the ranging transmitter 930 comprises an excitation source, e.g., an electromagnetic field source or a magnetic field source or an acoustic source, that provides the ranging signal and the ranging receiver is configured to detect the ranging signal, e.g., the magnetic field or acoustic signal, provided by the ranging transmitter 930. In certain embodiments, the ranging transmitter 930 and/or the ranging receiver 940 comprises one or more of a longitudinal, radial or tilted coil antenna. In certain embodiments, the ranging transmitter comprises a far-distance magnetic field generator, e.g., a solenoid of the type disclosed in FIGS. 5A-5C. In certain embodiments, the ranging transmitter comprises one or more of a low-frequency close-proximity ranging transmitter 932 and a pair of radially placed permanent magnetics 934, one or more of which rotates with the drill bit 912, forming a high-frequency close-proximity ranging transmitter.

In this example, the ranging receiver 940 is configured to measure a distance and a direction of another BHA relative to the BHA 910 and provide a ranging signal that includes the measured distance and the measured direction. The ranging receiver 940 is communicatively coupled to the lead-follow controller 942 that is configured to receive the ranging signal and provide a steering signal that includes a heading. The lead-follow controller 942 is further communicatively coupled to a steering controller 944 that is configured to receive the steering signal and steer the second BHA to the received heading. In certain embodiments, the functions attributed to the various components, e.g., ranging receiver 940, lead-follow controller 942, and steering controller 944, are implemented in different components. In certain embodiments, one or more components are located on the surface or in another section of the BHA.

Figure 10:
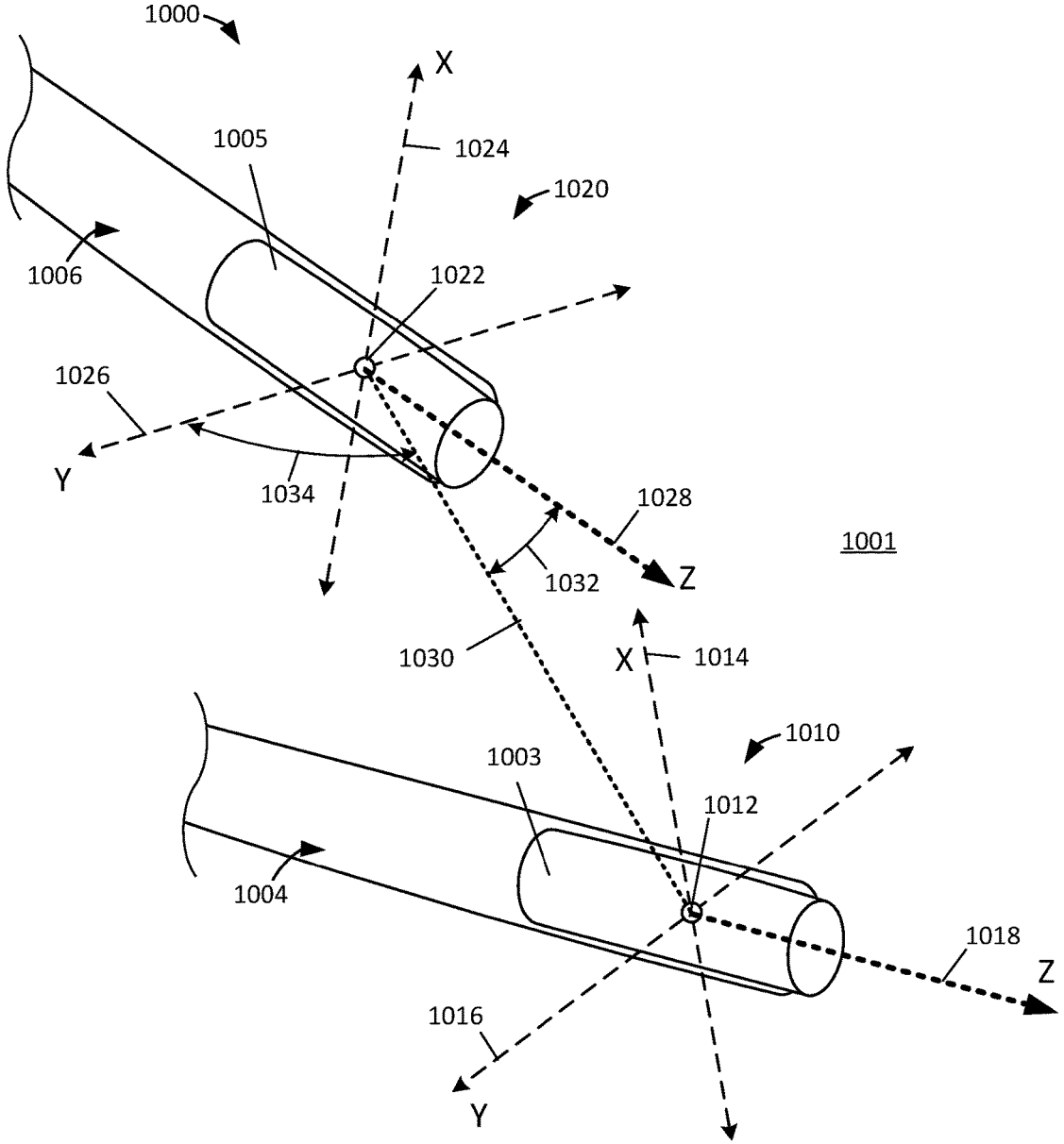
FIG. 10 depicts an example of a first BHA measuring a relative distance and relative direction of a second BHA, in accordance with various aspects of the subject technology.

FIG. 10 depicts an example of a first BHA measuring a relative distance and relative direction of a second BHA, in accordance with various aspects of the subject technology. The BHAs 1003, 1005 are respectively drilling boreholes 1004, 1006 through earth formation 1001. In certain embodiments, the BHAs 1003, 1005 have respective coordinate systems 1010, 1020 defined in the steerable portion of the BHAs that have respective centers 1012, 1022 with respective X axes 1016, 1026, respective Y axes 1014, 1024, and respective Z axes 1018, 1028. As the BHAs 1003, 1005 advance through the formation 1001 in the Z-axis direction, the Z axes 1018, 1028 are also referred to herein as "drilling axes." In certain embodiments, each of the BHAs 1003, 1005 can determine their position, e.g., true vertical depth (TVD), and/or orientation in 3D space relative their surface starting position.

In the example of FIG. 10, BHA 1005 is behind BHA 1003 with respect to the drilling axis 1028 of BHA 1005. In this situation, BHA 1005 is in a "follow state," also referred to herein as the "follower BHA," and BHA 1003 is in a "lead state," also referred to herein as the "leader BHA." In certain embodiments, the follower BHA 1005 measures a distance and a direction of a vector 1030 from the leader BHA 1005 to BHA 1003, i.e., the distance and direction are relative to a position and orientation of BHA 1005. In this example, the offset of the ranging transmitter (not visible in FIG. 10) of BHA 1003 from the coordinate center 1012 and the offset of the ranging receiver (not visible in FIG. 10) of BHA 1005 from the coordinate center 1022 are accounted for in the processing of the ranging signal by the lead-follow controller (not visible in FIG. 10) of BHA 1005. In certain embodiments, the direction of BHA 1003 with respect to BHA 1005 is defined by an X-Z angle 1032 and a Y-Z angle 1034. In certain embodiments, the direction is defined in polar coordinates or other known methods of defining a vector direction in 3D space.

In certain embodiments, the ranging receiver of the BHA 1005 emits a signal and detects an effect of the BHA 1003 on the emitted signal and uses the detected effect to measure the distance and direction of the BHA 1003 relative to the BHA 1005. In certain embodiments, the ranging receiver of the BHA 1005 emits a signal and detects an reflection of the emitted signal by the BHA 1003 and uses the reflected signal to measure the distance and direction of the BHA 1003 relative to the BHA 1005.

In certain embodiments, the follower BHA, e.g., BHA 1005, may not be able to detect the magnetic field of the lead BHA, e.g., BHA 1003. This may be due to a failure of the BHA 1003, BHA 1003 being out of range, or a change in the operation of BHA 1003, e.g., the BHA is being tripped out. In certain embodiments, when ranging receiver does not receive the ranging signal, the ranging signal data from the receiver will not contain one or more of the distance and direction or the distance and/or direction are not valid.

Figure 11:
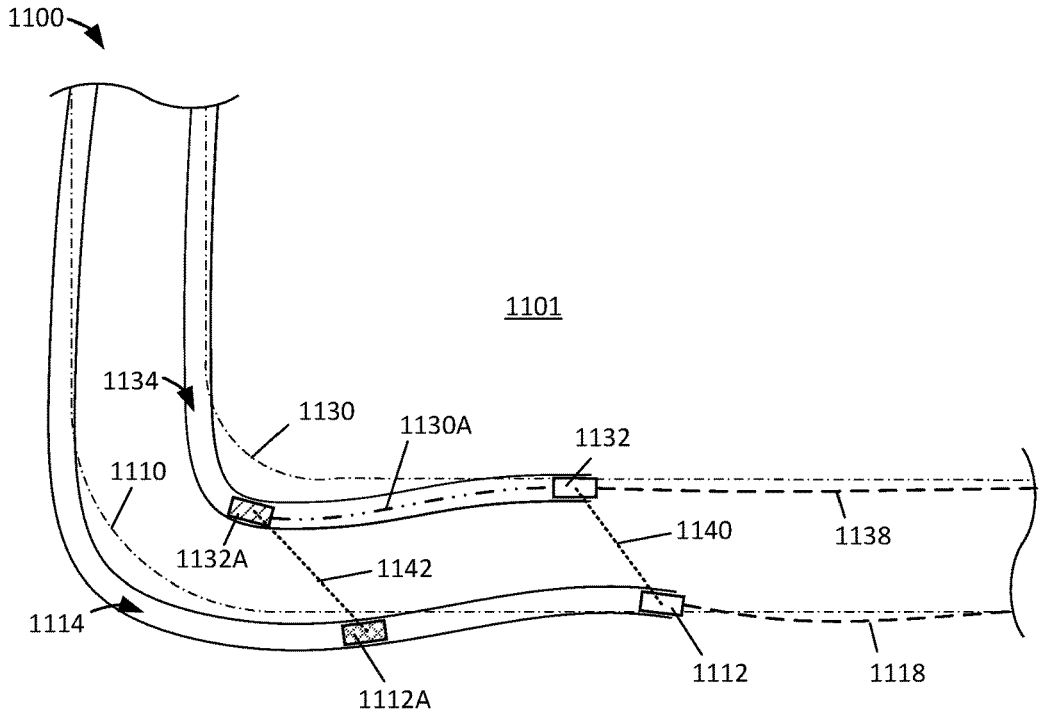
FIG. 11 depicts an example of a first BHA following a second BHA, in accordance with various aspects of the subject technology.

FIG. 11 depicts an example of a first BHA following a second BHA, in accordance with various aspects of the subject technology. In this example, BHA 1112 is in the lead state and BHA 1132 is in the follow state. BHA 1112 has a planned path 1110 and attempts to follow the path 1110, subject to the usual deviations in steering a BHA, and creates borehole 1114. In this example, the path descends to a predetermined depth and then turns to run horizontal. As can be seen in FIG. 11, the borehole 1114 deviates from the planned path 1110 with steering corrections to return to the planned path 1110. In certain embodiments, the lead-follow controller of BHA 1112 has the planned path stored in its memory and, based on the actual position of BHA 1112, the lead-follow controller will project a path 1118 and provide the steering controller with a heading that will direct the BHA 112 to follow the project path 1118 so as to return to the planned path 1110.

In an example wherein one BHA with a ranging transmitter follows a desired path, the BHA is operating in one or more of the following modes:

- Seek—look for either a ranging signal from, or reflected by, a nearby wellbore;
- Approach—follow a predetermined approach path once a distance and direction to a target wellbore has been detected;
- Follow—follow the nearby wellbore path while maintaining a desired separation distance and orientation;
- Lead—follows a planned or projected path for the current wellbore;
- Avoid—follow a path that steers away or around the detected nearby wellbore; and
- Intersect—intersect the path of the nearby wellbore at a desired depth, point, trajectory, and/or orientation.

The BHA can change between these modes throughout the drilling of a wellbore depending on the situation or steering objective.

In another example, it is desired to drill a second borehole 1134 that is separated from the first borehole 1114. In certain embodiments, the borehole 1134 is drilled by BHA 1132 that has its own planned path 1130 that has a defined spatial relationship to the planned path 1110, e.g., a 65 m TVD separation and a 15 m lateral separation. In certain embodiments, the spatial relationship comprises one or more constraints, e.g., a maximum allowed curvature of the wellbore, a constraint to avoid a nearby wellbore, and a constraint to intersection a nearby wellbore at desired depth or orientation. In certain embodiments, the intersection constraint comprises a predetermined convergence angle and/or a predetermined curvature to create the intended wellbore geometry. In certain embodiments, the spatial relationship includes one or more of a separation distance between the boreholes, a separation radial direction, e.g., borehole 1134 is intended to be vertically displaced and/or horizontally displaced from borehole 1114, and a point of intersection of borehole 1134 with borehole 1114. In certain embodiments, the constraint includes a separation tolerance that establishes a range, e.g., a minimum and a maximum separation distance and the lead-follow controller is configured to try and maintain the separation distance between the minimum and maximum distances. In certain embodiments, the constraint comprises a maximum allowed curvature of the wellbore.

In certain embodiments, each BHA has in memory the planned path for the primary wellbore as well as the offset from the primary path for each secondary, or follower, wellbore. BHA #1 has a zero offset from the primary path. If one of the other BHAs, e.g., BHA #3, assumes the lead role, then BHA #3 follows a projected path based on the primary path and the defined offset of BHA #3.

In certain embodiments, the planned path of the second borehole 1134 is defined solely by the desired spatial relationship. This feature may be ideal if the leader BHA is programmed to follow a geological feature rather than a geometric feature, in which case the leader BHA could autonomously geosteer and uses bed boundary distances and/or formation tomography or structures to help maintain follower BHAs in the desired position, such as within a given formation. For example, following a channel or reef formation. If the formation zone narrows or expands, the follow BHAs may autonomously or manually controlled by the operator, contract or expand their spatial relationship constraints within predefined limits while still following the leader BHA to optimize separation and reservoir placement.

While this example includes only two boreholes, the same principles can be extended to a plurality of boreholes of more than two boreholes with transmit and or receive capabilities typically carried within BHAs or installations by other means such as wireline and/or tractor conveyance, tubing conveyed systems etc., installations on completed casing/liner structures, wherein one of the plurality of boreholes is being drilled by a leader BHA and the remaining boreholes are being drilled by follower BHAs. In certain embodiments, all the boreholes are drilled at the same time. In certain embodiments, all BHAs can be a leader BHA, e.g., contain a ranging transmitter, and can also be a follower BHA, e.g., contain a ranging receiver and a lead-follow controller. In certain embodiments, borehole 1114 has been previously drilled and one or more additional boreholes are to be drilled along paths with defined spatial relationships to borehole 1114, wherein BHA 1112 is replaced by a downhole device carrying a ranging receiver or equivalent or a ranging transmitter or equivalent, that is moved through the borehole, e.g., via wireline, tubing or coil tubing, to provide a reference to follower BHAs such as BHA 1132.

In the example of FIG. 11, BHA 1132 is in a follow state and measured the distance and direction of BHA 1112 relative to BHA 1132, e.g., along vector 1140, and adjusts the heading of its RSS or other wellbore steering system, to maintain the defined spatial relationship of BHA 1132 to BHA 1112. It can be seen that borehole 1114 deviates from path 1110 at the turn. At a prior time while drilling, BHA 1112 was located at position 1112A on a heading directed back to path 1110 while, at the same time, BHA 1132 was located at position 1132A. BHA 1132A measured the distance and direction of BHA 1112A, as indicated by vector 1142, and modified the planned path 1130 to create an adjusted path 1130A that meets the spatial relationship with path of BHA 1112A. BHA 1132 continues to adjust its path based in part on the planned path 1130 and in part on the measured distance and measured direction of BHA 1112 relative to BHA 1132.

Returning to the BHA positions 1112 and 1132, leader BHA 1112 has projected a path 1118, e.g., to return to the planned path 1110, taking into account the steering characteristics of BHA 1112. At the same time, follower BHA 1132 has projected its own path 1138. In certain embodiments, if the ranging receiver of BHA 1132 fails or one or more of the distance and direction of BHA 1112 are not provided for any reason, the lead-follow controller will direct the steering controller to follow the projected path 1138. In certain embodiments, the projected path will return to the planned path. In certain embodiments, the projected path will be extended to maintain the spatial relationship with an expected path of BHA 1112 extending from the last known position of the BHA 1112.

In certain embodiments, BHA 1112 and BHA 11132 can communicate, either directly, e.g., through modulation of the magnetic field of the ranging transmitter of one BHA and detection of the modulation by the ranging receiver of the other BHA, or indirectly, e.g., by sending a signal upbore from one BHA using a mud pulser, and the surface equipment sending the same signal downhole to the other BHA. In certain embodiments, the BHAs can exchange their measured 3D positions as a substitute for the direct distance and direction measurement using the ranging transmitter and ranging receiver. In certain embodiments, the BHAs communicate to negotiate which BHA is in the lead state and which is in the follow state. For example, if BHA 1112 were to slow or stop and BHA 1132 were to move ahead of BHA 1112, BHA 1132 sends a signal to BHA 1112 to inform BHA 1112 that BHA 1132 has transitioned from a follow state to a lead state and BHA 1112 replies with a confirmation that BHA has transitioned to a follow state. In certain embodiments, an operator on the surface manually directs which BHA will lead and which BHA will follow via downlink telemetry commands using a surface transmitter, e.g., a drilling fluid pressure modulation system, or other forms of telemetry, e.g., a wired drill pipe or e-line coil tubing or electromagnetic telemetry or acoustic telemetry, or other downlink signaling methods, e.g., controlling the mud pump flow rate and/or rotary speed of the drill string.

In certain embodiments, BHA 1112, 1132 can communicate with the surface, e.g., a human operator, and receive/provide information and/or receive instructions. In certain embodiments, the surface system or operator can downlink a change in path, trajectory, orientation, and relative separation to one or more of the BHAs at any time regardless of whether they are a leading BHA or a following BHA. This would allow for changes in the overall path of the group of boreholes and their relative separation. In certain embodiments, the BHA provides commands that are received from the surface to the lead-follow controller. In certain embodiments, the lead-follow controller is configured to receive and store one or more of the planned first path, the planned second path, the defined spatial relationship of the second path to the first path, a change to the planned first path, a change to the planned second path, a change to the defined spatial relationship, the adjusted first path, the adjusted second path, the projected first path, the projected second path, a command to assume the follow state, and a command to assume the lead state.

Figure 12:
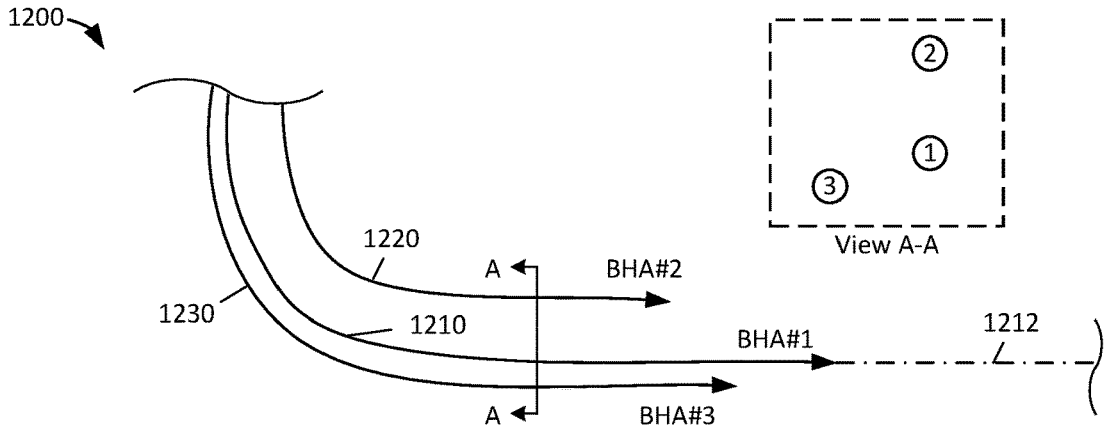
FIGS. 12-13 depict and example of BHAs changing roles, in accordance with various aspects of the subject technology.
Figure 13:
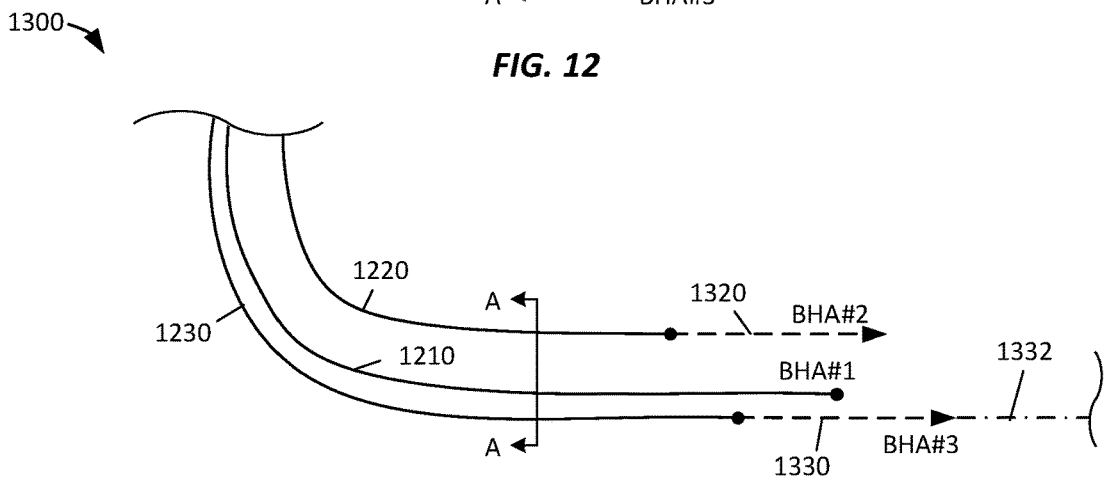

FIGS. 12-13 depict and example of BHAs changing roles, in accordance with various aspects of the subject technology.

FIG. 12 depicts a snapshot 1200 of wellbores 1210, 1220, 1230 at a first point in time. The X-Y positions of the three boreholes is shown in cross-section A-A. The BHA #1 has assumed the lead role and has created wellbore 1210, with a projected path 1212 extending from the current position indicated by the arrowhead. BHA #2 and BHA #3 are behind BHA #1, as determined with respect to their respective drilling axes, and have assumed follow roles.

FIG. 13 depicts a snapshot 1300 of wellbores 1210, 1220, 1230 at a second point in time later than the first point in time. BHA #1 stopped at the position of FIG. 12, as indicated by the arrowhead of FIG. 12 being replaced by the circle of FIG. 13. BHA #2 and BHA #3 have progressed forward along respective paths 1320 and 1330 and are now located at the respective arrowheads, both of which are ahead of BHA #1. BHA #2 can determine that it is ahead of BHA #1 and behind BHA #3. BHA #3 can determine that it is ahead of both BHA #1 and BHA #2 and, therefore, assumes the lead role. BHA #2, as it is still behind another BHA, retains its follow role.

In certain embodiments, BHA #1 is tripped out of the borehole and cannot be detected by BHA #2 or BHA #3. One of BHA #2 and BHA #3 assume the lead role. When BHA #1 is placed back in the borehole, it detects that it is behind BHA #2 and/or BHA #3 and BHA #1 switches autonomously to become a follower.

In certain embodiments, BHA #1, #2, and #3 communicate to exchange information and negotiate which BHA is the leader. In certain embodiments, BHA #2 is not able to detect the ranging signal of BHA #3 but can still determine the relative position of BHA #1. Through the exchange of the respective relative positions of BHA #2 and BHA #3 to BHA #1, BHA #2 and BHA #3 determine that BHA #3 is ahead of BHA #2 without direct detection of each other.

In certain embodiments, the leader BHA, e.g., BHA #1, delegates the lead role to one of the follower BHAs and BHA #1 takes on the role of a follower. With some hysteresis in this handoff, e.g., a minimum distance ahead of one BHA over the other to trigger a hand-over, the BHAs can exchange the roles of leader or follower as needed to maintain the desired collective trajectories of the paths and orientations. This may be required, for example, if it is necessary to stop drilling the leader BHA to allow the follower BHA to drill ahead and intersect the leader's projected path.

Figure 14:
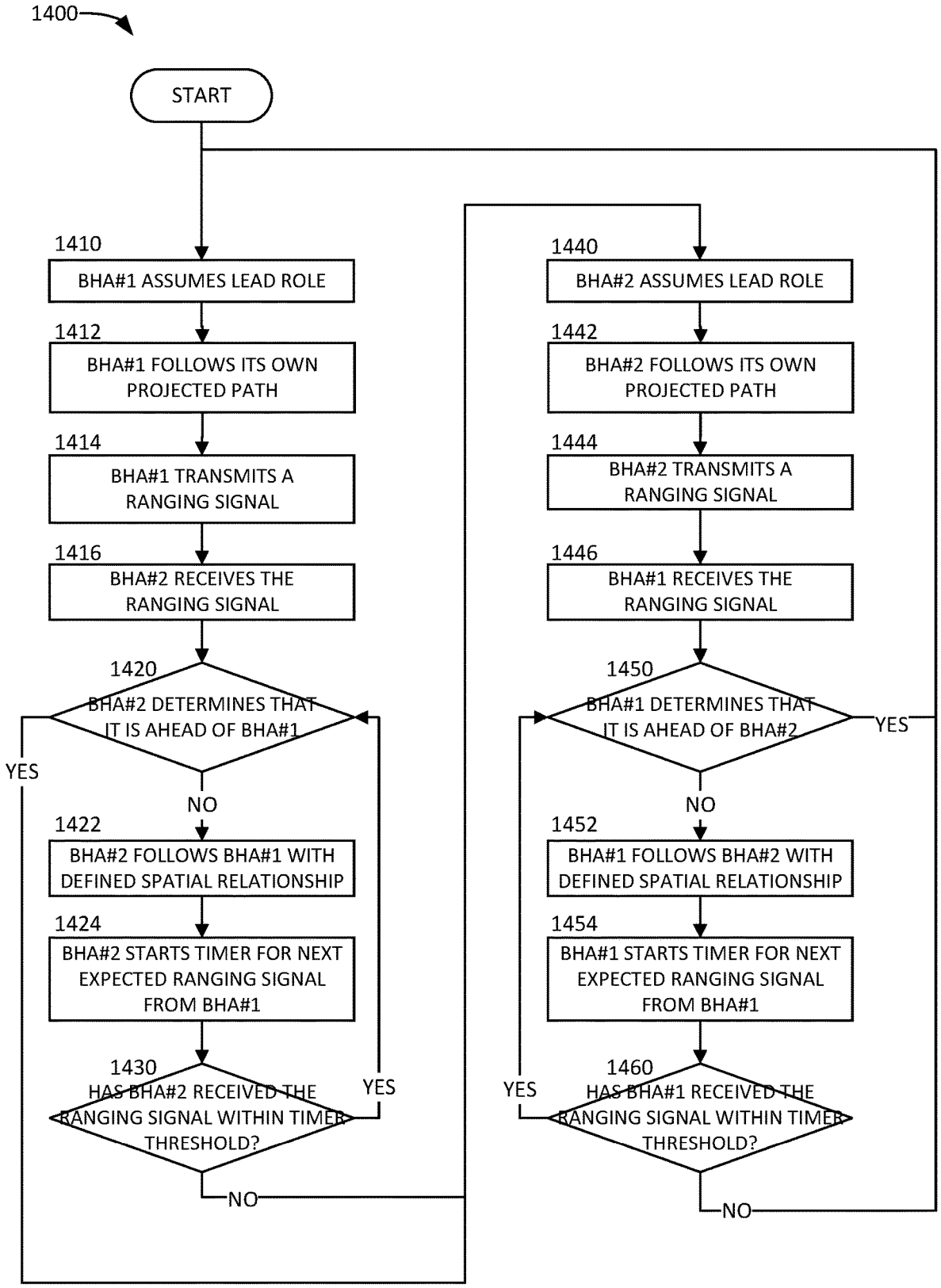
FIG. 14 is a flowchart of an example process for drilling multiple boreholes at the same time, in accordance with various aspects of the subject technology.

FIG. 14 is a flowchart 1400 of an example process for drilling multiple boreholes at the same time, in accordance with various aspects of the subject technology. The drilling starts with step 1410 wherein BHA #1 in the lead role and, by implication, BHA #2 in the follow role. In step 1412 BHA #1 follows its own path, which initially will be the original planned path determined prior to the start of drilling. BHA #1 transmits a ranging signal in step 1414 at a time known to both BHAs and BHA #2 receives the ranging signal in step 1416. In step 1420, BHA #2 measures the relative position of BHA #1 to BHA #2 and determines whether BHA #2 is ahead of BHA #1. If BHA #2 is ahead of BHA #1, the process branches to step 1440, otherwise proceeds to step 1422 wherein BHA #2 follows BHA #1 while trying to maintain the defined spatial relationship. BHA #2 starts a timer in step 1424 that has a threshold of the time at which it expects another ranging signal to be transmitted by BHA #1. If BHA #2 does not receive the ranging signal of BHA #1 by the time that the timer reaches the threshold, the process branches to step 1440, otherwise returns to step 1420.

If the process branches to step 1440 from either step 1420 or 1430, BHA #2 assumes the lead role and follows its own projected path in step 1442. BHA #2 now transmits a ranging signal in step 1444 and BHA #1, if it has assumed the follow role, will receive the ranging signal in step 1446 and determine whether it is ahead of BHA #2 in step 1450. In certain embodiments, if BHA #1 is not aware that BHA #2 has changed roles then BHA #1 will continue in a lead role and follow its own path, resulting in BHAs #1 and #2 steering independently. In this situation, if the BHAs are reporting to the operator controlling the drilling operation, the operator will detect that both BHAs are in lead role and take corrective action.

If BHA #1 assumed a follow role in step 1440, then BHA #1 will determine in step 1450 whether it is ahead of BHA #1. If BHA #1 determines that it is ahead of BHA #2, the process branches to step 1410, otherwise the process continues to step 1452 wherein BHA #1 follows BHA #2, step 1454 wherein BHA #1 starts a time, and step 1460 wherein BHA #1 determines whether it has received the ranging signal from BHA #2, branching back to step 1450 if it receives the ranging signal before the timer reaches the threshold and branching to step 1410 if it does not receive the ranging signal before the timer reaches the threshold.

In summary, the disclosed systems and methods provide a scalable means of drilling multiple boreholes in a desired configuration that may include a desired range of separation distance and/or a desired relative radial direction of the boreholes. The disclosed systems and methods also reduce the decision-making required by the operator at the surface by automating the lead-follow process.

For clarity of explanation, in some instances the present technology may be presented as including individual functional blocks including functional blocks comprising devices, device components, steps or routines in a method embodied in software, or combinations of hardware and software.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a non-volatile computer-readable memory, or other data storage medium, comprising program code including instructions that, when executed, performs one or more of the method, algorithms, and/or operations described above. The computer-readable data storage medium may form part of a computer program product, which may include packaging materials.

A computer-readable memory, as used herein, includes any type of storage media, e.g., a random access memory (RAM), a synchronous dynamic random access memory (SDRAM), a read-only memory (ROM), a non-volatile random access memory (NVRAM), an electrically erasable programmable read-only memory (EEPROM), a FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The phrase "urging an object" or similar means the application of a force to the object in a manner that will try and move the object toward a defined position or in a specific direction without implying that the object moves or that the object is restricted from moving in another direction, even backward with respect to the direction of the applied force.

Claim language reciting "an item" or similar language indicates and includes one or more than one of the items. For example, claim language reciting "a part" means one part or multiple parts.

Moreover, claim language reciting "at least one of" a set indicates that one member of the set or multiple members of the set satisfy the claim. For example, claim language reciting "at least one of A and B" means A, B, or A and B.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Statements of the disclosure include:

(A1) A method, comprising: drilling a first borehole along a planned first path using a first bottom hole assembly (BHA); drilling a second borehole using a second BHA along a second path having a defined spatial relationship to the first path; measuring a distance and a direction of the first BHA relative to the second BHA; automatically adjusting the second path based in part on the measured distance and the measured direction so as to maintain the spatial relationship; and automatically steering the second BHA to follow the adjusted second path.

(A2) The method of A1, wherein measuring the distance and direction comprises receiving, with the second BHA, a ranging signal transmitted by the first BHA.

(A3) The method of A2, wherein the spatial relationship comprises one or more of a separation distance, a separation radial direction, a constraint, and a point of intersection.

(A4) The method of A1, further comprising: projecting the second path when it is not possible to measure one or more of the distance and the direction; steering the second BHA to follow the projected second path while it is not possible to measure one or more of the distance and the direction; and resuming the adjusting of the second path when it is possible to resume measuring the distance and direction.

(A5) The method of A1, further comprising: determining whether the second BHA is in a follow state of being behind the first BHA or in a lead state of being ahead of the first BHA; and projecting the second path and steering the second BHA to follow the projected second path when the second BHA is in the lead state; wherein measuring the distance and the direction, adjusting the second path, and steering the second BHA to follow the adjusted second path are executed when the second BHA is in the follow state.

(A6) The method of A5, wherein: the second BHA comprises a drilling axis; the second BHA automatically transitions from the follow state to the lead state when the second BHA is ahead of the first BHA along the drilling axis by at least a first distance; and the second BHA automatically transitions from the lead state to the follow state when the second BHA is behind of the first BHA along the drilling axis by at least a second distance.

(A7) The method of A1, wherein measuring the distance and the direction, adjusting the second path so as to maintain the spatial relationship between the second path and the first path, and steering the second BHA to follow the adjusted second path are executed automatically by the second BHA.

(B8) A memory comprising instructions that when executed by one or more processors cause the one or more processors to: measure, while a first bottom hole assembly (BHA) is being used to drill a first borehole along a planned first path and a second BHA is being used to drill a second borehole along a second path having a defined spatial relationship to the first path, a distance and a direction of the first BHA with respect to the second BHA; automatically adjust the second path based in part on the measured distance and the measured direction so as to maintain the spatial relationship between the second path and the first path; and automatically steer the second BHA to follow the adjusted second path.

(B9) The memory of B8, wherein measuring the distance and the direction comprises the second BHA receiving a ranging signal transmitted by the first BHA.

(B10) The memory of B8, wherein the spatial relationship comprises one or more of a separation distance, a separation radial direction, a constraint, and a point of intersection.

(B11) The memory of B8, wherein the instructions further cause the one or more processors to: project the second path when it is not possible to measure one or more of the distance and the direction; steer the second BHA to follow the projected second path while it is not possible to measure one or more of the distance and direction; and resume the step of adjusting the second path when it is possible to resume measuring the distance and the direction.

(B12) The memory of B8, wherein the instructions further cause the one or more processors to: determine whether the second BHA is in a first state of being behind the first BHA or in a second state of being ahead of the first BHA; and project the second path and steering the second BHA to follow the projected second path when the second BHA is in the second state; and wherein the measuring the distance and the direction, adjusting the second path, and steering the second BHA to follow the adjusted second path are executed when the second BHA is in the first state.

(B13) The memory of B12, wherein: the second BHA comprises a drilling axis; the second BHA automatically transitions from the first state to the second state when the second BHA is ahead of the first BHA along the drilling axis by at least a first distance; and the second BHA automatically transitions from the second state to the first state when the second BHA is behind the first BHA along the drilling axis by at least a second distance.

(B14) The memory of B8, wherein the measuring the distance and the direction, adjusting the second path so as to maintain the spatial relationship between the second path and the first path, and steering the second BHA to follow the adjusted second path are executed automatically by the second BHA.

(C15) A system, comprising: a first bottom hole assembly (BHA) comprising a lead state configured to drill a first wellbore along a planned first path; and a second BHA comprising a follow state configured to drill a second wellbore while automatically following a second path that has a defined spatial relationship to the first path.

(C16) The system of C15, wherein: the second BHA will automatically change to the lead state when the second BHA is ahead of the first BHA along the drilling axis by at least a first distance; the second BHA will project the second path while in the lead state; and the first BHA will automatically adjust the first path to maintain the defined spatial relationship with the projected second path and automatically follow the adjusted first path.

(C17) The system of C16, wherein: the first BHA is notified when the second BHA changes to the lead state; and the first BHA changes to the follow state upon being notified that the second BHA has changed to the lead state.

(C18) The system of C16, wherein the second BHA will automatically change to the lead state when the second BHA is unable to measure one or more of the distance and the direction.

(C19) The system of C15, wherein the defined spatial relationship to the first path comprises one or more constraints.

(C20) The system of C15, wherein the second BHA comprises a ranging receiver, a lead-follow controller, and a steering controller; wherein: the ranging receiver is configured to measure a distance and a direction of the first BHA relative to the second BHA and provide the distance and the direction; the lead-follow controller is configured to: receive the distance and the direction; adjust the second path based in part on the received distance and direction to achieve the defined spatial relationship to the first path; determine a heading to guide the second BHA along the adjusted second path; and provide a steering signal comprising the heading; and the steering controller is configured to: receive the steering signal; and steer the second BHA to the heading.

What is claimed is:

1. A method, comprising:

drilling a first borehole along a planned first path using a first bottom hole assembly (BHA), wherein the first BHA is assigned as a lead BHA and wherein a pathway of the lead BHA is a controlling path;

drilling a second borehole using a second BHA along a second path having a defined spatial relationship to the first path, wherein the second BHA is assigned as a follow BHA that follows the lead BHA and is initially positioned behind the lead BHA, wherein a pathway of the following BHA is adjusted based on the lead BHA, and wherein the pathway of the lead BHA is a referencing path in maintaining the defined spatial relationship between the first path and a second path;

measuring a distance and a direction of the first BHA relative to the second BHA;

determining the second BHA has taken over as the lead BHA based on respective positions of the first BHA and second BHA; and projecting the second path and steering the second BHA to follow the projected second path based on the second BHA being the lead BHA, wherein the first BHA then automatically switches from the lead BHA to the follow BHA in response to the determination that the second BHA has taken over as the lead BHA.

2. The method of claim 1, wherein measuring the distance and direction comprises receiving, with the second BHA, a ranging signal transmitted by the first BHA.

3. The method of claim 2, wherein the spatial relationship comprises one or more of a separation distance, a separation radial direction, a constraint, and a point of intersection.

4. The method of claim 1, further comprising:

projecting the second path when it is not possible to measure one or more of the distance and the direction;

steering the second BHA to follow the projected second path while it is not possible to measure one or more of the distance and the direction; and resuming the adjusting of the second path when it is possible to resume measuring the distance and direction.

5. The method of claim 1, wherein measuring the distance and the direction, adjusting the second path, and steering the second BHA to follow the adjusted second path are executed when the second BHA is the follow BHA.

6. The method of claim 5, wherein:

the second BHA comprises a drilling axis;

the second BHA automatically switches from the follow BHA to the lead BHA when the second BHA is ahead of the first BHA along the drilling axis by at least a first distance; and the second BHA automatically switches from the lead BHA to the follow BHA when the second BHA is behind of the first BHA along the drilling axis by at least a second distance.

7. The method of claim 1, wherein measuring the distance and the direction, adjusting the second path so as to maintain the spatial relationship between the second path and the first path, and steering the second BHA to follow the adjusted second path are executed automatically by the second BHA.

8. The method of claim 1, further comprising:

operating the lead BHA and follow BHA in certain modes specific to the lead BHA and follow BHA, wherein the modes include at least one of a seek mode, an approach mode, a follow mode, a lead mode, an avoid move, or an intersect mode.

9. A memory comprising instructions that when executed by one or more processors cause the one or more processors to:

measure, while a first bottom hole assembly (BHA) is being used to drill a first borehole along a planned first path and a second BHA is being used to drill a second borehole along a second path having a defined spatial relationship to the first path, a distance and a direction of the first BHA with respect to the second BHA, wherein:

the first BHA is assigned as a lead BHA and a pathway of the lead BHA is a controlling path;

the second BHA is assigned as a follow BHA that follows the lead BHA and is initially positioned behind the lead BHA;

a pathway of the following BHA is adjusted based on the lead BHA; and the pathway of the lead BHA is a referencing path in maintaining the defined spatial relationship between the first path and the second path;

determine the second BHA has taken over as the lead BHA based on respective positions of the first BHA and second BHA; and project the second path and steer the second BHA to follow the projected second path based on the second BHA being the lead BHA, wherein the first BHA then automatically switches from the lead BHA to the follow BHA in response to a determination that the second BHA has taken over as the lead BHA.

10. The memory of claim 9, wherein measuring the distance and the direction comprises the second BHA receiving a ranging signal transmitted by the first BHA.

11. The memory of claim 9, wherein the spatial relationship comprises one or more of a separation distance, a separation radial direction, a constraint, and a point of intersection.

12. The memory of claim 9, wherein the instructions further cause the one or more processors to:

project the second path when it is not possible to measure one or more of the distance and the direction;

steer the second BHA to follow the projected second path while it is not possible to measure one or more of the distance and direction; and adjust the second path when it is possible to resume measuring the distance and the direction.

13. The memory of claim 9, wherein the measuring the distance and the direction, adjusting the second path, and steering the second BHA to follow the adjusted second path are executed when the second BHA is in the follow BHA.

14. The memory of claim 13, wherein:

the second BHA comprises a drilling axis;

the second BHA automatically switches from the lead BHA to the follow BHA when the second BHA is ahead of the first BHA along the drilling axis by at least a first distance; and the second BHA automatically switches from the follow BHA to the lead BHA when the second BHA is behind the first BHA along the drilling axis by at least a second distance.

15. The memory of claim 9, wherein the measuring the distance and the direction, adjusting the second path so as to maintain the spatial relationship between the second path and the first path, and steering the second BHA to follow the adjusted second path are executed automatically by the second BHA.

16. A system, comprising:

a first bottom hole assembly (BHA) assigned as a lead BHA configured to drill a first wellbore along a planned first path;

a second BHA assigned as a follow BHA configured to drill a second wellbore while automatically following a second path that has a defined spatial relationship to the first path, wherein:

the second BHA automatically switches to the lead BHA based on the second BHA being ahead of the first BHA; and the second BHA projects the second path based on the second BHA being the lead BHA;

the first BHA then automatically switches from the lead BHA to the follow BHA in response to a determination that the second BHA has taken over as the lead BHA; and the first BHA automatically adjusts the first path to maintain the defined spatial relationship with the projected second path and automatically follows the adjusted first path.

17. The system of claim 16, wherein:

the first BHA is notified when the second BHA switches to the lead BHA; and the first BHA automatically switches to the follow BHA upon being notified that the second BHA has switched to the lead BHA.

18. The system of claim 16, wherein:

the second BHA measures a distance and a direction of the first BHA relative to the second BHA; and the second BHA automatically switches and operates as an additional lead BHA based on the second BHA being unable to measure one or more of the distance and the direction.

19. The system of claim 16, further comprising a third BHA assigned as an addition to the follow BHA configured to drill a third wellbore while automatically following a third path that has a defined spatial relationship to the first path.

20. The system of claim 16, wherein the second BHA comprises a ranging receiver, a lead-follow controller, and a steering controller;

wherein:

the ranging receiver is configured to measure a distance and a direction of the first BHA relative to the second BHA and provide the distance and the direction; and the lead-follow controller is configured to:

receive the distance and the direction;

adjust the second path based in part on the received distance and direction to achieve the defined spatial relationship to the first path;

determine a heading to guide the second BHA along the adjusted second path; and provide a steering signal comprising the heading; and the steering controller is configured to:

receive the steering signal; and steer the second BHA to the heading.

* * * * *